US008636846B2

(12) United States Patent
Norimatsu

(10) Patent No.: US 8,636,846 B2
(45) Date of Patent: Jan. 28, 2014

(54) AEROSOL-GENERATING APPARATUS, FILM-FORMING APPARATUS, AND AEROSOL-GENERATING METHOD

(75) Inventor: Takahiro Norimatsu, Hekinan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1268 days.

(21) Appl. No.: 12/147,471

(22) Filed: Jun. 26, 2008

(65) Prior Publication Data

US 2009/0001198 A1 Jan. 1, 2009

(30) Foreign Application Priority Data

Jun. 29, 2007 (JP) ..... 2007-172028
Dec. 29, 2007 (JP) ..... 2007-341564

(51) Int. Cl.
*B05B 7/00* (2006.01)
*B05C 11/00* (2006.01)
*B05D 1/12* (2006.01)

(52) U.S. Cl.
USPC ..... 118/600; 118/300; 427/180

(58) Field of Classification Search
USPC ..... 118/DIG. 5
See application file for complete search history.

(56) References Cited

U.S. PATENT DOCUMENTS

| | | | | |
|---|---|---|---|---|
| 2,561,392 | A * | 7/1951 | Marshall | 427/213 |
| 3,871,328 | A * | 3/1975 | English | 118/629 |
| 4,338,878 | A * | 7/1982 | Mason et al. | 118/429 |
| 4,869,469 | A * | 9/1989 | Eylon et al. | 266/202 |
| 2004/0227227 | A1 | 11/2004 | Imanaka et al. | |

FOREIGN PATENT DOCUMENTS

| | | | |
|---|---|---|---|
| JP | H05-15815 | A | 1/1993 |
| JP | H05-238560 | A | 9/1993 |
| JP | H09-253476 | A | 9/1997 |
| JP | 2001-232248 | A | 8/2001 |
| JP | 2004113931 | A | 4/2004 |
| JP | 2004195340 | A | 7/2004 |
| JP | 2004267990 | A | 9/2004 |
| JP | 2004339565 | A | 12/2004 |

OTHER PUBLICATIONS

Satoru, JP 2004-113931, English translation.*
Mracek et al, "A system for powder transport based on piezoelectrically excited ultrasonic progressive waves," Mat. Chem. Phys., 90, 378-380 (2005).*
The State Intellectual Property Office of the People's Republic of China; Notification of First Office Action in Chinese Patent Application No. 200810129563.5 (counterpart to the above-captioned U.S. patent application) mailed Apr. 29, 2010.

* cited by examiner

*Primary Examiner* — Dah-Wei Yuan
*Assistant Examiner* — Charles Capozzi
(74) *Attorney, Agent, or Firm* — Baker Botts L.L.P.

(57) ABSTRACT

An aerosol-generating apparatus includes a body having a powder-accommodating chamber which accommodates a powder of the material particles, and an introducing port via which the carrier gas is introduced into the powder-accommodating chamber; a powder flow passage which has an inlet opening and an outlet opening both of which are open in the powder-accommodating chamber, the inlet opening being positioned at a position lower than that of the outlet opening in a vertical direction; and a transport mechanism which transports the powder in a direction directed from the inlet opening to the outlet opening of the powder flow passage. Accordingly, the aerosol-generating apparatus is provided, which makes it possible to stably produce the aerosol over a long period of time by appropriately reducing the aggregation of the material particles accommodated in the powder-accommodating chamber.

19 Claims, 17 Drawing Sheets

AEROSOL-GENERATING APPARATUS, FILM-FORMING APPARATUS, AND AEROSOL-GENERATING METHOD

CROSS REFERENCE TO RELATED APPLICATION

The present application claims priorities from Japanese Patent Application Nos. 2007-172028 and 2007-341564 filed on Jun. 29, 2007 and Dec. 29, 2007, respectively, the disclosures of which are incorporated herein by reference in their entirety.

BACKGROUND OF THE INVENTION

1. Field of the Invention

The present invention relates to an aerosol-generating apparatus, a film-forming apparatus, and an aerosol-generating method.

2. Description of the Related Art

The aerosol deposition method (hereinafter referred to as "AD method") is such a technique that material particles, which are converted into an aerosol by being mixed with a carrier gas, are introduced into a reduced pressure space in a film-forming chamber, and the material particles are jetted from a nozzle toward a substrate at a high velocity on the basis of a differential pressure between the internal pressure of the film-forming chamber and the internal pressure of the nozzle so that a coating composed of the material particles is formed on the substrate thereby. In the case of the AD method as described above, for example, when the particle sizes or diameters of the material particles are adjusted to select an appropriate film formation condition, a dense film of the material particles can be formed at a high speed at the normal temperature.

The standard equipment of the film-forming apparatus based on the use of the AD method includes an aerosol-generating apparatus which is capable of forming the aerosol such that the material particles, which are contained in a previously prepared powder, are mixed and dispersed in the carrier gas.

A problem has been hitherto pointed out about the fact that the material particles are aggregated or coagulated and the particle sizes of the material particles are increased when the aerosol-generating apparatus is used for a long period of time. The clusters of the material particles (aggregates of material particles), which are formed by aggregating and solidifying the material particles, tend to stay at a lower portion of the powder accommodated in the aerosol-generating apparatus. Therefore, a particle size distribution arises in the powder such that the particle diameter of the material particle aggregate is increased at lower positions. The aggregates having large particle sizes are gathered in a large amount in the lower layer of the powder. Therefore, the material particles are hardly dispersed in the carrier gas. Any appropriate agitation or stirring function and any appropriate fluidization, which are to be brought about by the carrier gas, are inhibited by the aggregates of the material particles in relation to the entire powder contained in the aerosol-generating apparatus. The aggregation of the material particles is further facilitated. In relation thereto, it is also considered that the agitation state and/or the fluidization state of the powder is adjusted by adjusting, for example, the gas flow rate of the carrier gas. However, whether the gas flow rate of the carrier gas is large or small exerts a serious influence on the coating characteristic of the material particles with which the substrate is to be coated. Therefore, there is obviously a certain limit to suppress the aggregation of the material particles by adjusting the agitation state and/or the fluidization state of the powder by adjusting the flow rate of the carrier gas.

Finally, the material particles, which are disposed at the lower portion of the powder, cannot be converted into the aerosol. Any trouble arises in the long-term stable generation of the aerosol to be brought about by the aerosol-generating apparatus. In other words, in the case of the conventional aerosol-generating apparatus, it is extremely difficult to maintain a constant concentration of the material particles in the aerosol for a long period of time. This fact causes a serious obstacle against the practical use (industrial application) of the film-forming apparatus based on the use of the AD method.

In order to deal with the problem as described above, film-forming apparatuses are disclosed in Japanese Patent Application Laid-open Nos. 2004-113931 and 2004-339565, each of which is provided with a driving means for applying, for example, the minute vibration to an aerosol-generating vessel. For example, in the case of an aerosol-generating apparatus described in Japanese Patent Application Laid-open No. 2004-113931, a predetermined motion can be applied together with the minute vibration to the aerosol-generating vessel in which the aerosol is produced. Therefore, it is affirmed that the aggregates of material particles do not stay without being unevenly distributed at any portion of the vessel, and it is possible to stably produce the aerosol.

SUMMARY OF THE INVENTION

According to the knowledge of the present inventors, when the vibration and/or the motion is applied to the aerosol-generating vessel as in the conventional film-forming apparatus as described above, the adhesion of the material particles, for example, to the wall portion of the vessel is advanced in some cases. The stable formation of the aerosol is inversely inhibited in some cases.

The present invention has been made taking the foregoing circumstances into consideration, an object of which is to provide an aerosol-generating apparatus, a film-forming apparatus, and an aerosol-generating method which make it possible to stably produce an aerosol for a long period of time by appropriately reducing the aggregation of material particles accommodated in a powder-accommodating chamber.

According to a first aspect of the present invention, there is provided an aerosol-generating apparatus which generates an aerosol by dispersing material particles in a carrier gas, the aerosol-generating apparatus including:

a body having a powder-accommodating chamber which accommodates a powder of the material particles, and an introducing port which is formed in the powder-accommodating chamber and via which the carrier gas is introduced into the powder-accommodating chamber;

a powder flow passage which has an inlet opening and an outlet opening both of which are open in the powder-accommodating chamber, the inlet opening being positioned at a position lower than that of the outlet opening in a vertical direction; and a transport mechanism which transports the powder accommodated in the powder flow passage in a direction directed from the inlet opening to the outlet opening of the powder flow passage.

Accordingly, the circulation type fluidization of the powder is caused, and the fluidization layer can be formed in the powder. Owing to the circulation type fluidization in the powder, it is possible to appropriately reduce the aggregation of the material particles even when the aerosol-generating apparatus is used for a long period of time. For example, an effect is obtained by the fluidization in the powder as described above such that the aggregates of the material particles are rubbed with each other, and the aggregates are pulverized. Further, the following effect is also obtained. That is, when the powder is allowed to fall by the self-weight from the falling position onto the powder surface, the aggregates of the material particles can be pulverized by the falling energy brought about when the aggregates are allowed to fall by the self-weight.

Owing to the pulverizing effect exerted on the aggregates of the material particles as described above, it is possible to stably produce the aerosol over a long term by means of the aerosol-generating apparatus.

In the present invention, it is desirable that the inlet opening of the powder flow passage is positioned under or below the powder surface of the powder, and the outlet opening is positioned over or above the powder surface of the powder.

The aerosol-generating apparatus of the present invention may further include a carrier gas supply mechanism which supplies the carrier gas from outside of the body to the powder-accommodating chamber via the introducing port. In this arrangement, the aerosol can be generated or produced even when a factory or the like is not provided with any appropriate gas supply mechanism, because the aerosol-generating apparatus has the carrier gas supply mechanism.

In the aerosol-generating apparatus of the present invention, the powder flow passage may be formed of a flow passage member, the transport mechanism may have a vibrator which vibrates the flow passage member to transport the powder accommodated in the powder flow passage.

In this arrangement, the powder, which enters the flow passage member from the inlet opening of the flow passage member, is appropriately transported against the gravity in the direction directed to the outlet opening of the flow passage member in accordance with the action of the ultrasonic transport of the powder effected by the vibrator.

In the aerosol-generating apparatus of the present invention, the vibrator may be attached to one of a portion of the flow passage member which is located in the vicinity of the inlet opening and another portion of the flow passage member which is located in the vicinity of the outlet opening. Alternatively, the vibrator may be attached only to the another portion of the flow passage member which is located in the vicinity of the outlet opening. In any case, it is possible to efficiently transport the powder. In particular, it is considered that the powder can be transported at a high efficiency when the vibrator is attached to only the portion which is disposed in the vicinity of the outlet opening.

In the aerosol-generating apparatus of the present invention, the body may have a carrier gas-introducing chamber which is formed at a position below the powder-accommodating chamber, and a penetrating pore member in which a plurality of penetrating pores is formed and which comparts the powder-accommodating chamber and the carrier gas-introducing chamber; the introducing port may be formed in the carrier gas-introducing chamber; and a discharge opening through which the carrier gas is discharged may be formed in the carrier gas supply mechanism to be connected to the introducing port formed in the carrier gas-introducing chamber.

In this arrangement, the carrier gas is introduced from the carrier gas-introducing chamber via the penetrating pore member into the powder-accommodating chamber. Therefore, it is possible to obtain a substantially uniform flow of the carrier gas allowed to enter the powder-accommodating chamber.

In the aerosol-generating apparatus of the present invention, the powder flow passage may be formed of a tubular member, and the inlet opening may be positioned in a layer of the powder accommodated in the powder-accommodating chamber.

In the aerosol-generating apparatus of the present invention, tubular member may be a linear tube-shaped member having a central axis extending substantially in the vertical direction; and the tubular member may penetrate through a substantially central portion of a horizontal cross section of the powder-accommodating chamber at a position corresponding to a top of a powder surface.

In any case, the powder can be sucked upwardly from the inlet opening positioned in the layer of the powder. In particular, when the inlet opening of the flow passage member is positioned at the inside at the central portion of the powder accommodated in the powder-accommodating chamber, the powder can be sucked upwardly from the central portion. Therefore, the powder is suppressed from any deviated distribution. When the flow passage member has the straight-tubular form, it is possible to exhibit the strong force to suck the powder upwardly.

In the aerosol-generating apparatus of the present invention, the penetrating pore member may be a funnel-shaped member in which a discharge port is formed; the inlet opening of the powder flow passage may be connected to the discharge port of the funnel-shaped penetrating pore member; and the outlet opening of the powder flow passage may be arranged inside the powder-accommodating chamber.

In the aerosol-generating apparatus of the present invention, the inlet opening of the powder flow passage may be formed on an inner wall surface of the powder-accommodating chamber; and the outlet opening of the powder flow passage may be arranged inside the powder-accommodating chamber.

In the aerosol-generating apparatus of the present invention, an angle formed with respect to a horizontal plane by a straight line connecting the outlet opening and a position, at which the inner wall surface, facing oppositely to the opening of the powder-accommodating chamber, may be larger than an angle of repose of the powder of the material particles.

In this arrangement, the powder can be returned to the powder surface from the position which is sufficiently separated from the inlet opening of the flow passage member. As a result, it is possible to effect the fluidization in a wide area of the powder while collapsing the wall of the powder formed by the angle of repose at the opposing position described above.

In the aerosol-generating apparatus of the present invention, an angle formed with respect to a horizontal plane by a straight line connecting the inlet opening and the outlet opening, may be larger than an angle of repose of the powder of the material particles.

In this arrangement, even when the amount of the powder is decreased as the aerosol of the powder is progressively formed, it is possible to avoid such a situation that the powder does not arrive at the inlet opening due to the wall of the powder formed by the angle of repose at the inlet opening.

In the aerosol-generating apparatus of the present invention, the penetrating pore member may be a plate-shaped member which is arranged to incline such that the powder of the material particles is moved toward the inlet opening by a self-weight of the material particles.

In this arrangement, the powder, which is disposed at any position separated from the inlet opening, can be forcibly moved to the inlet opening in accordance with the self-weight of the powder.

The aerosol-generating apparatus of the present invention may further include a gas-jetting mechanism which jets the carrier gas toward the powder falling from the outlet opening of the powder flow passage toward a powder surface.

In the aerosol-generating apparatus of the present invention, the gas-jetting mechanism may have a jetting port arranged in the powder-accommodating chamber so that a falling route of the powder falling from the outlet opening of the powder flow passage toward the powder surface intersects a jetting area of the gas-jetting mechanism.

In any case, the powder during the falling onto the powder surface is pulverized or broken in the jetting area of the gas-jetting mechanism. When the powder during the falling onto the powder surface is made to be sufficiently fine, then the powder does not fall onto the powder surface, and the powder is converted into the aerosol by means of the carrier gas. In particular, when the falling route of the powder allowed to fall from the outlet opening of the powder flow passage toward the powder surface intersects the jetting area of the gas-jetting mechanism, it is possible to efficiently break the aggregated powder.

In particular, it is possible to appropriately perform the breakage of the material particles in addition to the pulverization of the aggregates of the material particles. Therefore, even when the material particles have large particle sizes to such an extent that the material particles are not suitable for the aerosol formation to remain as the powder, the aerosol-generating apparatus can break the material particles so that the material particles are suitable for the aerosol formation in accordance with the cooperation with the circulation type fluidization of the powder as described above. As a result, it is possible to continuously produce the aerosol until the powder is used up or completely used without taking out the powder to the outside by opening the accommodating vessel.

According to a second aspect of the present invention, there is provided an aerosol-generating method for generating an aerosol by dispersing material particles in a carrier gas, the aerosol-generating method including:

accommodating a powder of the material particles in a powder-accommodating chamber;

supplying the carrier gas into the powder-accommodating chamber;

transporting the powder located below a powder surface of the powder accommodated in the powder-accommodating chamber to a falling position located above the powder surface; and making the powder transported to the falling position to fall toward the powder surface.

According to the second aspect of the present invention, the circulation type fluidization of the powder is caused, and it is possible to form the fluidization layer at the inside of the powder. Owing to the circulation type fluidization in the powder, it is possible to appropriately reduce the aggregation of the material particles in the powder-accommodating chamber. For example, the following effect is obtained owing to the fluidization in the powder as described above. That is, the aggregates of the material particles are rubbed with each other, and the aggregates are pulverized. Further, the following effect is also obtained. That is, when the powder is allowed to fall from the falling position toward the powder surface by the self-weight, the aggregates of the material particles can be pulverized by the falling energy obtained when the powder is allowed to fall in accordance with the self-weight.

Owing to the pulverizing effect on the aggregates of the material particles as described above, it is possible to stably produce the aerosol in the powder-accommodating chamber over a long term.

In the aerosol-generating method of the present invention, a part of the powder, which is located below the powder surface, may be transported via a powder flow passage to the falling position by vibrating, with a vibrator, a flow passage member forming the powder flow passage, the powder flow passage having an inlet opening and an outlet opening formed therein, the inlet opening being located below the powder surface of the powder accommodated in the powder-accommodating chamber and the outlet opening being located above the powder surface In this procedure, the powder, which enters the flow passage member from the inlet opening of the flow passage member, is appropriately transported in the direction directed to the outlet opening of the flow passage member against the gravity in accordance with the action of the ultrasonic transport of the powder effected by the vibrator.

The aerosol-generating method of the present invention may further include jetting the carrier gas from a gas-jetting mechanism toward the powder falling from the falling position toward the powder surface.

In this procedure, the powder during the falling toward the powder surface is pulverized or broken by the carrier gas jetted from the gas-jetting mechanism. When the powder during the falling toward the powder surface is made to be sufficiently fine, the powder is formed into the aerosol by the carrier gas without allowing the powder to fall onto the powder surface.

In particular, it is possible to appropriately perform the breakage of the material particles in addition to the pulverization of the aggregates of the material particles. Therefore, even when the material particles have large particle sizes to such an extent that the material particles are not suitable for the aerosol formation to remain as the powder, the material particles can broken so that the material particles are suitable for the aerosol formation in accordance with the cooperation with the circulation type fluidization of the powder as described above. As a result, it is possible to continuously produce the aerosol until the powder is used up or completely used without taking out the powder to the outside by opening the accommodating vessel.

The aerosol-generating apparatus of the present invention may further include a vibrator which is capable of applying, to a flow passage member, a maximum acceleration brought about by vibration applied by the vibrator to a tube member, the vibration having a magnitude necessary to make the powder to flow downwardly when the powder is accommodated in the tube member formed with a columnar internal space having a cross-sectional area which is 10% of an opening cross-sectional area of the flow passage member of the powder flow passage.

In this arrangement, the vibration condition is appropriately set for the vibrator attached to the flow passage member. It is possible to increase the fluidity of the powder accommodated in the flow passage member. Consequently, it is possible to appropriately avoid the sedimentation or deposition of the powder, for example, on the inner wall of the flow passage member.

In the aerosol-generating apparatus of the present invention, a magnitude of the maximum acceleration brought about by the vibration of the vibrator may be set to be not less than a magnitude of the maximum acceleration to correspond to a rising position of a flow rate profile of the powder based on a correlative relationship between the maximum acceleration and a flow rate of the powder flowing through the tube member.

In the aerosol-generating apparatus of the present invention, a magnitude of the maximum acceleration brought about by the vibration of the vibrator may be set to be not less than a magnitude of the maximum acceleration to correspond to a position of the flow rate profile which provides a half of a maximum value of the flow rate profile.

In the aerosol-generating apparatus of the present invention, the maximum acceleration brought about by the vibration of the vibrator may be set to be not more than twenty times the maximum acceleration to correspond to the rising position of the flow rate profile.

In any case, the vibration of the vibrator can be used to efficiently enhance the fluidity of the powder in the flow passage member without damaging the flow passage member. Consequently, it is possible to appropriately avoid the sedimentation or deposition of the powder, for example, on the inner wall of the flow passage member.

According to a third aspect of the present invention, there is provided a film-forming apparatus which forms a film of material particles on a substrate by jetting, to the substrate, an aerosol in which the material particles are dispersed in a carrier gas, the film-forming apparatus including:

an aerosol-generating device which generates the aerosol by dispersing the material particles in the carrier gas, the aerosol-generating device including a body having a powder-accommodating chamber which accommodates a powder of the material particles and in which an introducing port introducing the carrier gas into the powder-accommodating chamber is formed; a powder flow passage in which an inlet opening and an outlet opening are formed, the inlet opening and the outlet opening being opened in the powder-accommodating chamber, the inlet opening being located at a position lower than that of the outlet opening in a vertical direction; and a transport mechanism which transports the powder accommodated in the powder flow passage in a direction directed from the inlet opening to the outlet opening of the powder flow passage;

a film-forming device having a holder which holds the substrate, a jetting nozzle which is arranged to face the substrate held by the holder and through which the aerosol generated in the aerosol-generating section is jetted toward the substrate, and a chamber which accommodates the holder and the jetting nozzle and an internal space of which is maintained in a reduced pressure; and a controller which controls the aerosol-generating section and the film-forming section.

According to the third aspect of the present invention, the film-forming apparatus has the aerosol-generating device (section) concerning the present invention. Therefore, it is possible to generate the circulation type fluidization in the powder, and it is possible to pulverize the aggregates of the material particles. Therefore, it is possible to stably produce the aerosol over a long term, and it is possible to stably produce the film over a long term.

According to the aerosol-generating apparatus, the film-forming apparatus, and the aerosol-generating method of the present invention, it is possible to stably generate or produce the aerosol over a long period of time by appropriately reducing the aggregation of the material particles which are accommodated in the powder-accommodating chamber.

DESCRIPTION OF THE PREFERRED EMBODIMENTS

Figure 1:
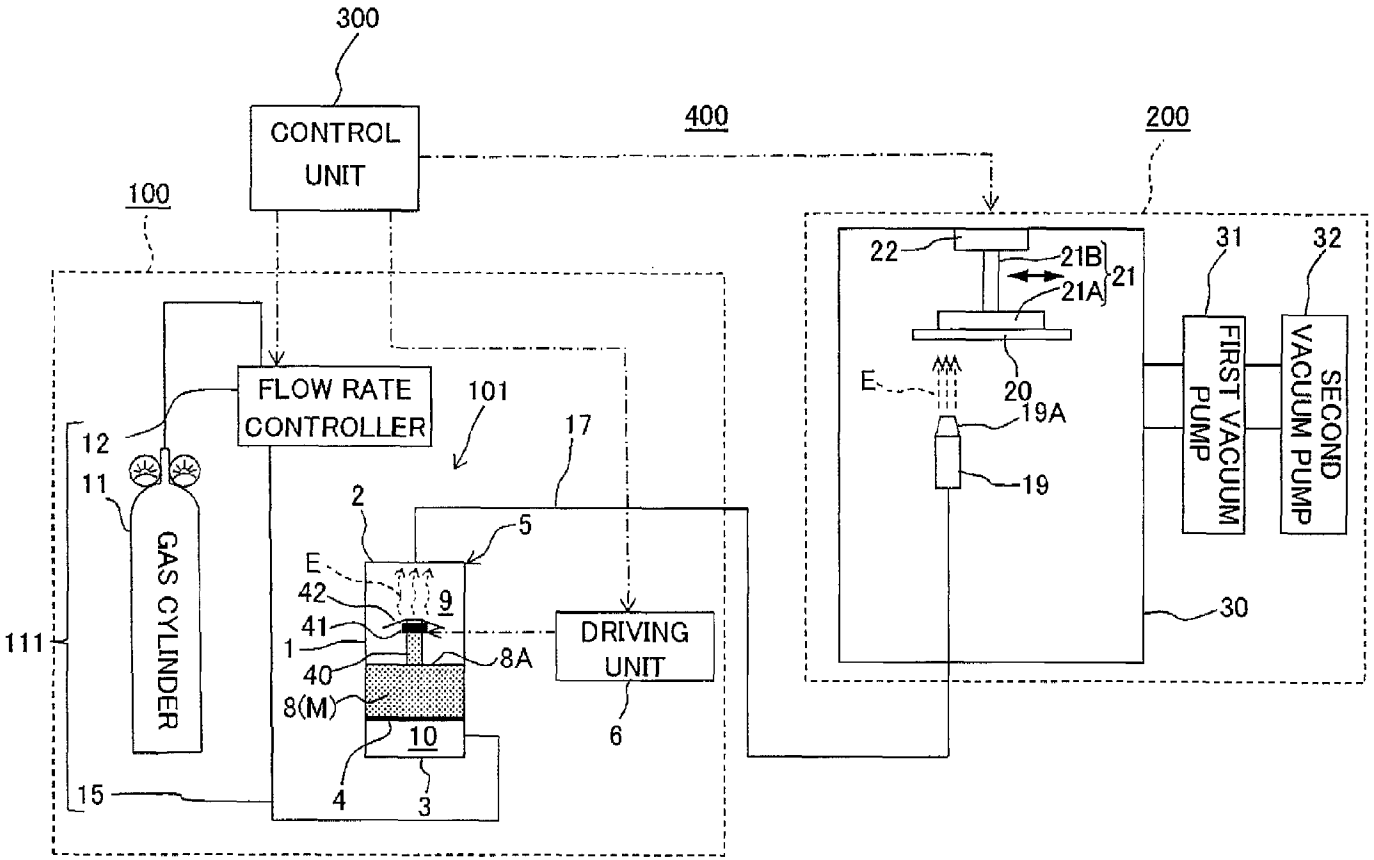
FIG. 1 schematically shows an exemplary arrangement of a film-forming apparatus equipped with an aerosol-generating apparatus according to a first embodiment of the present invention.

Preferred embodiments of the present invention will be explained below with reference to the drawings. In all of the drawings, the components or parts, which are the same as or equivalent to those shown in any other drawing, are designated by the same reference numerals. The contents, which are duplicated or overlapped with each other in the respective embodiments or modified embodiments thereof, will be appropriately omitted from the explanation.

In the following description, the direction, in which the gravity acts, is referred to as "downward direction", and the direction, which is opposite to the above, is referred to as "upward direction". If necessary, the upward and downward directions are referred to as "vertical direction" in other words, and the direction, which is perpendicular to the vertical direction, is referred to as "horizontal direction".

First Embodiment

FIG. 1 schematically shows an example of a film-forming apparatus equipped with an aerosol-generating apparatus (aerosol-generating section) according to a first embodiment of the present invention. In FIG. 1 (as well as in the first, second, third, and fourth embodiments as described later on), the internal situations of an accommodating vessel or container 5 and a film-forming chamber 30 are shown.

As shown in FIG. 1, a film-forming apparatus 400 used for the AD method includes an aerosol-generating mechanism 100 which generates the aerosol E by mixing a carrier gas and material particles M contained in a powder 8, a film-forming mechanism (film-forming section) 200 which forms a film of the material particles M by jetting the aerosol E generated by the aerosol-generating mechanism 100 toward a substrate 20, and a control unit (control section, controller) 300 which controls the operations of the aerosol-generating mechanism 100 and the film-forming mechanism 200.

At first, the aerosol-generating mechanism 100 of the film-forming apparatus 400 will be explained.

As shown in FIG. 1, the aerosol-generating mechanism 100 is provided with an aerosol-generating apparatus 101, a gas cylinder 11 (gas supply source), and a flow rate controller (mass flow controller) 12.

The aerosol-generating apparatus 101 includes an accommodating vessel 5 which corresponds to a main body thereof, and a circulating fluidization mechanism 180 for the powder 8 arranged in the accommodating vessel 5. The accommodating vessel 5 includes a cylindrical wall section 1 which has the central axis in the vertical direction, and disk-shaped first and second lid members 2, 3 which close the internal space of the accommodating vessel 5. The constitutive components disposed in the accommodating vessel 5 and the circulating fluidization mechanism 180 will be described in detail later on.

A carrier gas, which is to be supplied to the interior of the aerosol-generating apparatus 101, is charged to the gas cylinder 11. Those usable as the carrier gas to be supplied to the aerosol-generating apparatus 101 include, for example, inert gas such as helium gas and argon gas, air, oxygen gas, and nitrogen gas.

A connecting port 10B, which connects a carrier gas piping 15 and a carrier gas-introducing chamber 10 (described later on) of the accommodating vessel 5, is formed on the wall section 1 of the accommodating vessel 5 (see FIG. 2). An aerosol piping 17, which is communicated with the interior of a powder-accommodating chamber 9 (described later on) of the aerosol-generating apparatus 101, is provided on the first lid member 2.

The carrier gas piping 15 of the aerosol-generating apparatus 101 has a forward end opening 15A (discharge opening, see FIG. 2) for discharging the carrier gas. The forward end opening 15A is connected to the connecting port 10B of the carrier gas-introducing chamber 10, and thus the carrier gas piping 15 is communicated with the carrier gas-introducing chamber 10. An opening (proximal end opening, not shown) of the carrier gas piping 15, which is disposed on the side opposite to the forward end opening 15A, is communicated with a gas outlet (not shown) of the gas cylinder 11. The flow rate controller 12 described above is provided at an intermediate portion of the carrier gas piping 15. The flow rate controller 12 can be used to adjust the gas supply amount from the gas cylinder 11 to the carrier gas-introducing chamber 10. A mass flow controller is used as the flow rate controller 12 in this embodiment.

A carrier gas supply mechanism 111, which supplies the carrier gas to the carrier gas-introducing chamber 10 of the accommodating vessel 5, is constructed by the gas cylinder 11, the flow rate controller 12, and the carrier gas piping 15 explained above. The gas supply mechanism 111 may be provided integrally with the aerosol-generating apparatus 101. Alternatively, the gas supply mechanism 111 may be provided independently from the aerosol-generating apparatus 101. For example, any gas supply mechanism 111, which is equipped for a factory or the like, can be also connected to the aerosol-generating apparatus 101.

Next, the film-forming mechanism 200 of the film-forming apparatus 400 will be explained.

As shown in FIG. 1, the film-forming mechanism 200 is provided with the film-forming chamber 30, and first and second vacuum pumps 31, 32 which evacuate the interior of the film-forming chamber 30.

The first and second vacuum pumps 31, 32 are provided at the side wall portions of the film-forming chamber 30. The interior of the film-forming chamber 30 is subjected to the pressure reduction to provide an appropriate vacuum degree (for example, about 1 kPa) by means of the first and second vacuum pumps 31, 32. The first vacuum pump 31 is a known mechanical booster pump. The second vacuum pump 32 is a known mechanical type rotary pump. However, vacuum pumps of any other type may be used as the vacuum pumps. It is desirable that the interior of the film-forming chamber 30 can be subjected to the pressure reduction to about 1 kPa by means of the vacuum pumps.

The aerosol piping 17 described above penetrates through the bottom wall portion of the film-forming chamber 30. The aerosol piping 17 extends upwardly in the film-forming chamber 30 to make communication with the interior of a jetting nozzle 19 for jetting the aerosol E. A slit-shaped forward end opening (aerosol outlet, not shown) is formed at the forward end of a jetting section 19A of the jetting nozzle 19. A part of the inner wall of the jetting section 19A is formed so that the part is narrowed (to provide a tapered shape) at positions nearer to the forward end opening. Accordingly, the aerosol E is appropriately accelerated in the jetting section 19A.

A substrate holder 21 is provided to face the jetting nozzle 19 (correctly to the forward end opening of the jetting section 19A) in the film-forming chamber 30. The substrate holder 21 has a holder section 21A and a support section 21B. The holder section 21A of the substrate holder 21 is capable of holding the substrate 20. The support section 21B of the substrate holder 21 is connected to a substrate holder-driving mechanism 22. Accordingly, the substrate holder-driving mechanism 22 is capable of applying the driving force in the horizontal direction to the substrate holder 21. Therefore, the substrate 20, which is held by the substrate holder 21, is movable relatively with respect to the jetting nozzle 19 (in other words, with respect to the forward end opening of the jetting section 19A). A mask member (not shown) may be installed between the jetting nozzle 19 and the substrate 20 to make it possible to form the coating on the substrate 20 at any arbitrary position to have any arbitrary shape. Examples of the substrate 20 include, for example, metal substrates, silicon substrates (semiconductor substrates), and resin substrates.

Next, the control unit 300 of the film-forming apparatus 400 will be explained.

The control unit 300 is composed of a computer such as a microcomputer. The control unit 300 includes a calculation processing section composed of CPU, a storage section composed of a memory such as ROM and RAM, an output section such as a display monitor, and an operation input section such as a keyboard (any of these components is not shown). The calculation processing section reads a predetermined control program stored in the storage section to perform various types of the control in relation to the film-forming apparatus 400 on the basis of the control program.

The control unit 300 adjusts the flow rate of the gas to be supplied to the aerosol-generating apparatus 101 by using the flow rate controller 12. Accordingly, it is possible to control the flow rate of the aerosol E and the concentration of the material particles M in the aerosol E produced in the aerosol-generating apparatus 101. For example, the control unit 300 can adjust the flow rate of the gas as the operation amount so that the concentration of the material particles M is a desired concentration on the basis of the detection of the concentration of the material particles M in the aerosol E by means of an appropriate detector (not shown).

The control unit 300 is also capable of adjusting the output of a piezoelectric vibrator 41 by using a driving unit 6 as described later on. Accordingly, the control unit 300 can control the operation (for example, the amount of the powder 8 to be circulated) of the circulation type fluidization of the powder 8 accommodated in the powder-accommodating chamber 9. The contents of the circulation type fluidization of the powder 8 will be specifically described later on.

The control unit 300 detects the vacuum degree in the film-forming chamber 30 by means of an appropriate vacuum gauge (not shown) to perform the feedback control of the opening degrees of gas discharge valves (not shown) of the first and second vacuum pumps 31, 32 so that the interior of the film-forming chamber 30 is maintained to be in a desired vacuum state on the basis of the detected vacuum degree.

The control unit 300 controls the substrate holder-driving mechanism 22 so that the film having a desired thickness is formed in a desired area of the substrate 20.

In this specification, the term "control unit" means not only the single control unit but also the control unit group in which a plurality of control units are cooperated to execute the control of the film-forming apparatus. Therefore, it is not necessarily indispensable that the control unit is composed of a single control unit. The control unit may comprise a plurality of control units which are arranged in a dispersed manner, wherein the plurality of control units cooperatively control the film-forming apparatus.

Next, the aerosol-generating apparatus 101 of this embodiment will be explained in detail with reference to FIG. 2.

Figure 2:
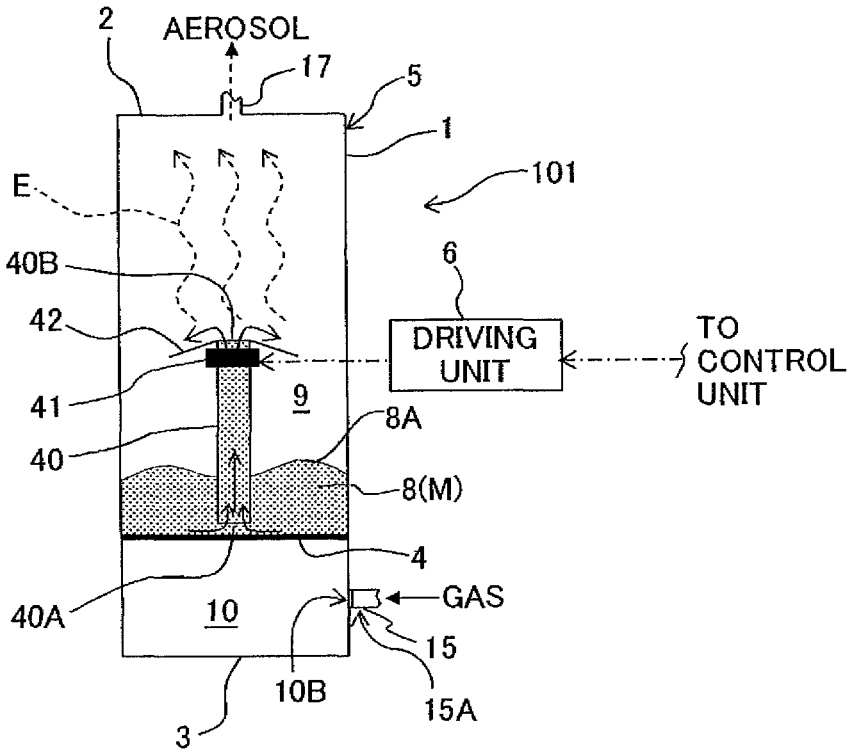
FIG. 2 schematically shows main components of the exemplary arrangement of the aerosol-generating apparatus according to the first embodiment of the present invention.

FIG. 2 schematically shows main components of the exemplary arrangement of the aerosol-generating apparatus according to the first embodiment of the present invention.

A plate-shaped penetrating pore member (porous member) 4 is provided in the accommodating vessel 5 described above so that the internal space is comparted into two chambers. The upper space, which is included in the internal space of the accommodating vessel 5 and which is comparted by the penetrating pore member 4, functions as the powder-accommodating chamber 9 for accommodating the powder 8 of the material particles M. The lower space functions as the carrier gas-introducing chamber 10 for introducing the carrier gas into the powder-accommodating chamber 9.

The penetrating pore member 4 has a large number of penetrating pores (not shown). The powder 8 of the material particles M is accommodated in a state of being sedimented or deposited on the penetrating pore member 4. In this specification, the term "penetrating pore member" means the member which is plate-shaped and which has a plurality of fine through-holes formed in the thickness direction. The through-holes also include the minute punching pores formed with the punch metal and the minute sieves of the microsieves. It is desirable that the diameters of the through-holes formed through the penetrating pore member 4 have a size to such an extent that any gaseous matter such as the gas is capable of passing therethrough but the material particles M are incapable of passing therethrough. For example, it is preferable that the diameters of the plurality of through-holes are equivalent to the particle sizes of the material particles M or the diameters of the plurality of through-holes are slightly smaller than the particle sizes of the material particles M. Any arbitrary material is available as the material particle N provided that the material is usable for the AD method. For example, it is possible to use lead titanate zirconate (PZT) as piezoelectric material, inorganic powder such as alumina, and organic powder such as resin. The particle diameter of the material particle M may be a particle diameter capable of being used in the film formation process based on the AD method. For example, the material particle M may be fine powder within a range of several hundreds nm to several tens μm.

The carrier gas, which is discharged from the carrier gas piping 15 as described above, passes from the carrier gas-introducing chamber 10 through the through-holes of the penetrating pore member 4, and the carrier gas is mixed in the powder 8 of the material particles M. Accordingly, the material particles M are allowed to blow upwardly from the powder 8, which are dispersed in the carrier gas and converted into the aerosol. In this situation, the powder 8, which is composed of a large number of the material particles M, is fluidized or subjected to the fluidization by the carrier gas. The fluidization herein refers to the fact that the powder is allowed to be in a state in which the powder 8 is capable of fluidization as if the powder 8 is a liquid. In other words, the carrier gas has the function to carry the material particles M to generate the aerosol E, and the carrier gas has the function as the fluidization gas to allow the powder 8 to fluidize in the powder-accommodating chamber 9. However, as described above, it is known that the large or small amount of the gas flow rate of the carrier gas exerts the serious influence on the coating characteristic of the material particles M onto the substrate 20. Therefore, there is obviously a limit to control the aggregation of the material particles M by adjusting the fluidization state and the agitation state of the powder by means of the flow rate control of the carrier gas.

In this specification, the layer of the powder 8, which behaves as if it is a liquid as described above, is referred to as "fluidization layer". The surface (uppermost surface) of the layer of the powder 8 sedimented or precipitated in the powder-accommodating chamber 9 is referred to as "powder surface 8A".

Next, an explanation will be made about the circulating fluidization mechanism 180 which causes the circulation type fluidization of the powder 8 in the aerosol-generating apparatus 101.

The circulating fluidization mechanism 180 of this embodiment is provided with a straight tube-shaped flow passage member 40 (tubular member) which is arranged in the powder-accommodating chamber 9, the piezoelectric vibrator 41 (transport mechanism, powder transport mechanism) which applies the ultrasonic wave vibration to the flow passage member 40, and the driving unit 6 which supplies the AC electric power as the driving electric power to the piezoelectric vibrator 41.

The flow passage member 40 constitutes the powder flow passage for transporting the powder 8. In this embodiment, the flow passage member 40 is a cylindrical piping made of resin (for example, made of acrylic resin). As shown in FIG. 2, the central axis of the flow passage member 40 extends in the vertical direction. The flow passage member 40 penetrates through the horizontal virtual cross section of the powder-accommodating chamber 9 at the central portion, the horizontal virtual cross section being a virtual plane positioned at the height position of the powder surface 8A of the powder 8. The flow passage member 40 extends deeply to the vicinity of the penetrating pore member 4. In other words, an inlet opening 40A of the flow passage member 40 is positioned in the vicinity of the lowermost layer at the center of the powder 8 accommodated in the powder-accommodating chamber 9. An outlet opening 40B is positioned over or above the powder surface 8A.

As described above, the inlet opening 40A is positioned under or below the powder surface 8A of the powder 8, and the outlet opening 40B is positioned over or above the powder surface 8A. However, the powder 8, which enters the flow passage member 40 from the inlet opening 40A of the flow passage member 40, can be transported in the direction (upward direction) directed to the outlet opening 40B of the flow passage member 40 against the gravity in accordance with the action of the ultrasonic wave transport (as described later on) of the powder 8 effected by the piezoelectric vibrator 41 as described later on. Accordingly, the powder 8, which exists at the inside of the sedimentation layer of the powder 8, can be transported to the position disposed over or above the powder surface 8A. In order to perform the circulating transport against the gravity as described above, it is necessary that the position of the inlet opening 40A should be set under or below the position of the outlet opening 40B in the vertical direction. Additionally, it is necessary that the charging amount of the powder 8 to be charged into the powder-accommodating chamber 9 should be determined so that the position of the powder surface 8A in the vertical direction is defined between the inlet opening 40A and the outlet opening 40B. Therefore, it is desirable that the inlet opening 40A and the outlet opening 40B of the flow passage member 40 are positioned while being separated from each other to some extent in the vertical direction. The powder 8 accommodated in the flow passage member 40 is transported from the inlet opening 40A to the outlet opening 40B by the known ultrasonic transport technique. The ultrasonic wave transport will be briefly explained below. The ultrasonic wave transport utilizes the two waves of the progressive wave and the stationary wave generated in the flow passage member 40 by the piezoelectric vibrator 41. In other words, the stationary wave is generated on the wall surface of the flow passage member 40 in accordance with the vibration of the piezoelectric vibrator 41. Accordingly, the condensation and rarefaction of the air (pressure difference of the air) are formed in the flow passage member 40. Accordingly, the powder 8 (material particle M) is trapped at the position at which the air is dilute, and the powder 8 (material particle M) is allowed to float by being separated from the wall portion of the flow passage member 40. When the progressive wave is generated on the flow passage member 40 in this state, the combined wave, which is composed of the stationary wave and the progressive wave, is generated. The powder 8 in the flow passage member 40 can be transported in the upward direction in a non-contact state while allowing the powder 8 to float. The frequency of the stationary wave generated for the flow passage member 40 by the piezoelectric vibrator 41 is, for example, 400 kHz. The frequency of the progressive wave is adjusted, for example, depending on the powder flow rate on the basis of the frequency of the stationary wave. The driving electric power is, for example, 4 W.

In this embodiment, the piezoelectric vibrator 41, which generates the stationary wave and the progressive wave (ultrasonic wave) transmitted through the flow passage member 40, is attached in the vicinity of the outlet opening 40B of the flow passage member 40 for the following reason. That is, it is empirically known that the powder 8 can be efficiently (smoothly) transported ultrasonically when the piezoelectric vibrator 41 is attached in the vicinity of the outlet opening 40B of the flow passage member 40. However, the attachment position of the piezoelectric vibrator 41 is not limited thereto. The piezoelectric vibrator 41 may be attached in the vicinity of the inlet opening 40A of the flow passage member 40.

Each one of the piezoelectric vibrators 41 may be attached to vicinity of the inlet opening 40A of the flow passage member 40 and the vicinity of the outlet opening 40B of the flow passage member 40 respectively. In this arrangement, the stationary wave can be generated on the flow passage member 40 by one piezoelectric vibrator 41, and the progressive wave can be generated on the flow passage member 40 by the other piezoelectric vibrator 41.

An annular umbrella-shaped plate (ring-shaped plate) 42 is arranged around the outlet opening 40B disposed at the upper end of the flow passage member 40. The umbrella-shaped plate 42 is such a member that the powder 8, which is allowed to outflow from the outlet opening 40B of the flow passage member 40, is allowed to fall from the appropriate falling position (specifically the position at the end of the umbrella-shaped plate 42) toward the powder surface 8A in accordance with the self-weight. A method for setting the falling position will be explained in relation to a jet mill 80 in the fourth embodiment described later on.

Figure 17:
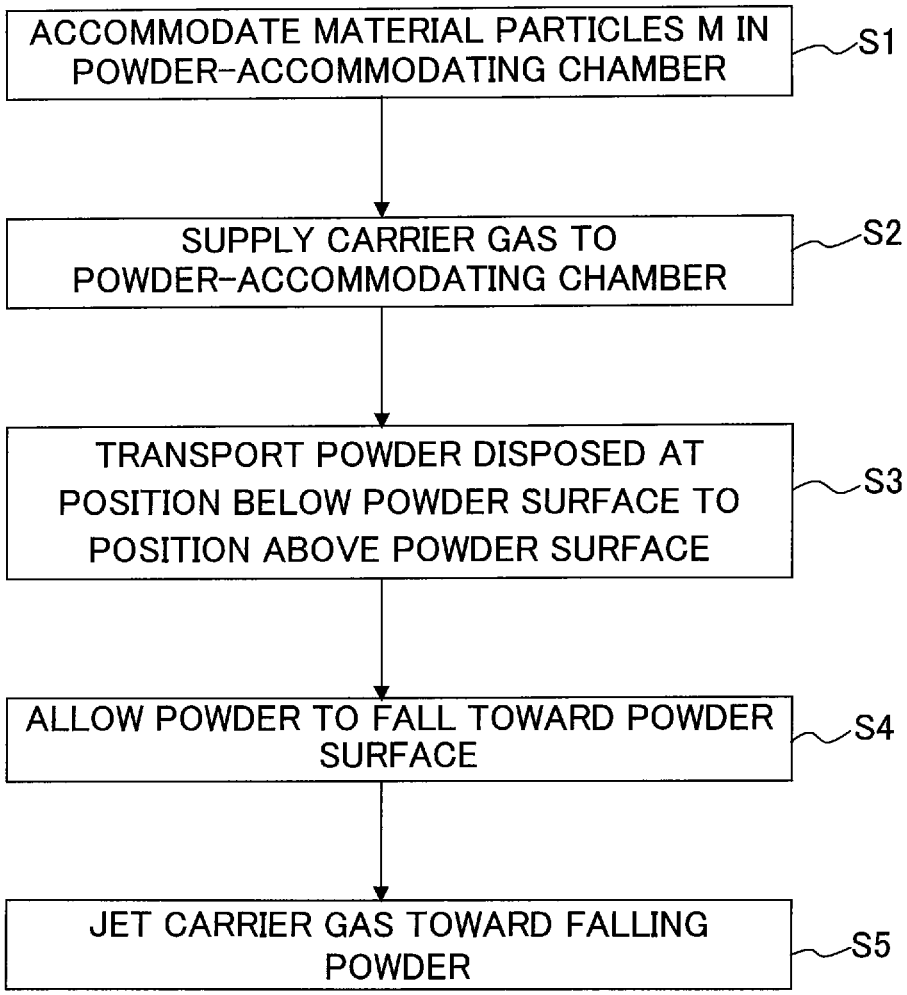
FIG. 17 shows a flow chart illustrating an exemplary operation of the film-forming apparatus equipped with the aerosol-generating apparatus of the embodiment of the present invention.

Next, an explanation will be made with reference to FIGS. 1 and 2 and a flow chart shown in FIG. 17 about an exemplary operation of the film-forming apparatus 400 equipped with the aerosol-generating apparatus 101 of this embodiment.

At first, the substrate 20 is set to the substrate holder 21 in the film-forming chamber 30. The powder 8 of the metal particles M is accommodated in the powder-accommodating chamber 9 of the accommodating vessel 5 (correctly on the penetrating pore member 4) (S1).

Subsequently, the gas is supplied from the gas cylinder 11 via the carrier gas piping 15 into the powder-accommodating chamber 9 (S2). The carrier gas, which is discharged from the carrier gas piping 15, is once introduced into the carrier gas-introducing chamber 10 of the accommodating vessel 5. The carrier gas-introducing chamber 10 functions as a buffer, and hence the influence, which would be otherwise exerted by the flow rate distribution of the flow of the carrier gas in the tube, is mitigated. In other words, the carrier gas, which is introduced from the carrier gas-introducing chamber 10 via the penetrating pore member 4 into the powder-accommodating chamber 9, forms a substantially uniform flow, and the carrier gas is capable of entering the powder-accommodating chamber 9. In this way, the carrier gas allows the material particles M in the powder 8 to blow upwardly. The material particles M, which are allowed to blow upwardly, are dispersed and mixed in the carrier gas. Accordingly, the aerosol E is generated in the powder-accommodating chamber 9. In this situation, the flow rate of the gas to be supplied to the accommodating vessel 5 (carrier gas-introducing chamber 10) is adjusted by the control unit 300 by using the flow rate controller 12. Accordingly, the flow rate of the aerosol E and the concentration of the material particles M in the aerosol E generated in the powder-accommodating chamber 9 are controlled.

The control unit 300 adjusts the AC voltage to be applied to the piezoelectric vibrator 41 by using the driving unit 6. The ultrasonic wave (stationary wave and progressive wave) vibration is generated on the flow passage member 40 by the piezoelectric vibrator 41. The powder 8 contained in the flow passage member 40 is transported by the ultrasonic wave (by the ultrasonic-transportation) against the gravity (S3). Accordingly, the powder 8 contained in the flow passage member 40 can be transported in the direction directed from the inlet opening 40A to the outlet opening 40B of the flow passage member 40. The powder 8 contained in the flow passage member 40 is finally transported to the falling position (position of the end of the umbrella-shaped plate 42 in this embodiment as described above) disposed above the powder surface 8A. After that, the powder 8 falls toward the powder surface 8A in accordance with the self-weight from the falling position (S4). The transport operation for transporting the powder 8 as described above is performed continuously, and the circulation type fluidization is caused in the powder 8.

On the other hand, the interior of the film-forming chamber 30 is in the reduced pressure state (is depressurized) owing to the vacuum suction effected by the first and second pumps 31, 32. Accordingly, the aerosol E, which is contained in the accommodating vessel 5 (powder-accommodating chamber 9), is sucked into the aerosol piping 17 in accordance with the differential pressure between the internal pressure of the film-forming chamber 30 and the internal pressure of the accommodating vessel 5. The aerosol E, which is allowed to flow through the aerosol piping 17, is jetted at a high velocity toward the substrate 20 in the film-forming chamber 30 from the forward end of the jetting nozzle 19. The material particles M, which are contained in the aerosol E jetted at the high velocity, collide with the surface of the substrate 20. The material particles M are crushed or broken by the collision energy. Fragments, which are produced by crushing the material particles M, are sedimented or deposited on the surface of the substrate 20 to form a film.

As described above, the aerosol-generating apparatus 101 of this embodiment is provided with the flow passage member 40 which has the inlet opening 40A formed at the position lower than the powder surface 8A in the powder-accommodating chamber 9 and the outlet opening 40B formed at the position higher than the powder surface 8A, and the piezoelectric vibrator 41 which vibrates the flow passage member 40 so that the stationary wave and the progressive wave (ultrasonic wave), which are transmitted through the flow passage member 40, are generated.

Owing to the construction as described above, the powder 8, which enters the flow passage member 40 from the inlet opening 40A of the flow passage member 40, is transported in the direction directed to the outlet opening 40B of the flow passage member 40 against the gravity in accordance with the action of the ultrasonic transport of the powder 8 effected by the piezoelectric vibrator 41. The powder 8 arrives at the falling position (end of the umbrella-shaped plate 42 in this embodiment). After that, the powder 8 falls toward the powder surface 8A in accordance with the self-weight from the falling position. On the other hand, the inlet opening 40A of the flow passage member 40 is positioned in the vicinity of the lowermost layer at the center of the powder 8 accommodated in the powder-accommodating chamber 9. Therefore, the powder 8 can be sucked from this portion. In particular, the flow passage member 40 has the straight tube form. It is possible to exhibit the strong suction force to suck the powder 8, which is preferred.

When the circulation type fluidization of the powder 8 is caused as described above, it is possible to form the fluidization layer in the powder 8.

When the powder 8 is fluidized so that the powder 8 is circulated, it is possible to appropriately reduce the aggregation of the material particles M even when the aerosol-generating apparatus 101 is used for a long period of time. In this embodiment, the following effect is obtained owing to the fluidization of the powder 8. That is, the aggregates of the material particles M are rubbed with each other, and the aggregates are pulverized (in other words, the aggregates of the material particles M are decomposed into the material particles M). Further, in this embodiment, the following effect is obtained. That is, the powder 8 is allowed to fall by the self-weight from the falling position toward the powder surface 8A, and hence the aggregates of the material particles M can be pulverized by means of the falling energy brought about when the aggregates fall by the self-weight. In this case, the distance in the height direction (difference in height of the powder 8) between the falling position and the powder surface 8A may be appropriately set in accordance with the comparison between the potential energy of the aggregates of the material particles M at the failing position and the aggregation energy exerted among the material particles M.

Even if the difference in height of the powder 8 is approximately zero, the aerosol-generating apparatus 101 exhibits the effect to pulverize the aggregates on the basis of the fluidization in the powder 8 as described above. In this specification, the term "falling" also includes such a situation. In other words, it is also allowable that the outlet opening 40B of the flow passage member 40 is set at approximately the same height as that of the powder surface 8A.

Owing to the pulverizing effect to pulverize the aggregates of the material particles M as described above, it is possible to stably produce the aerosol E over a long term by the aerosol-generating apparatus 101 (in other words, it is possible to obtain the constant concentration of the material particles M in the aerosol E over a long term).

Second Embodiment

Figure 3:
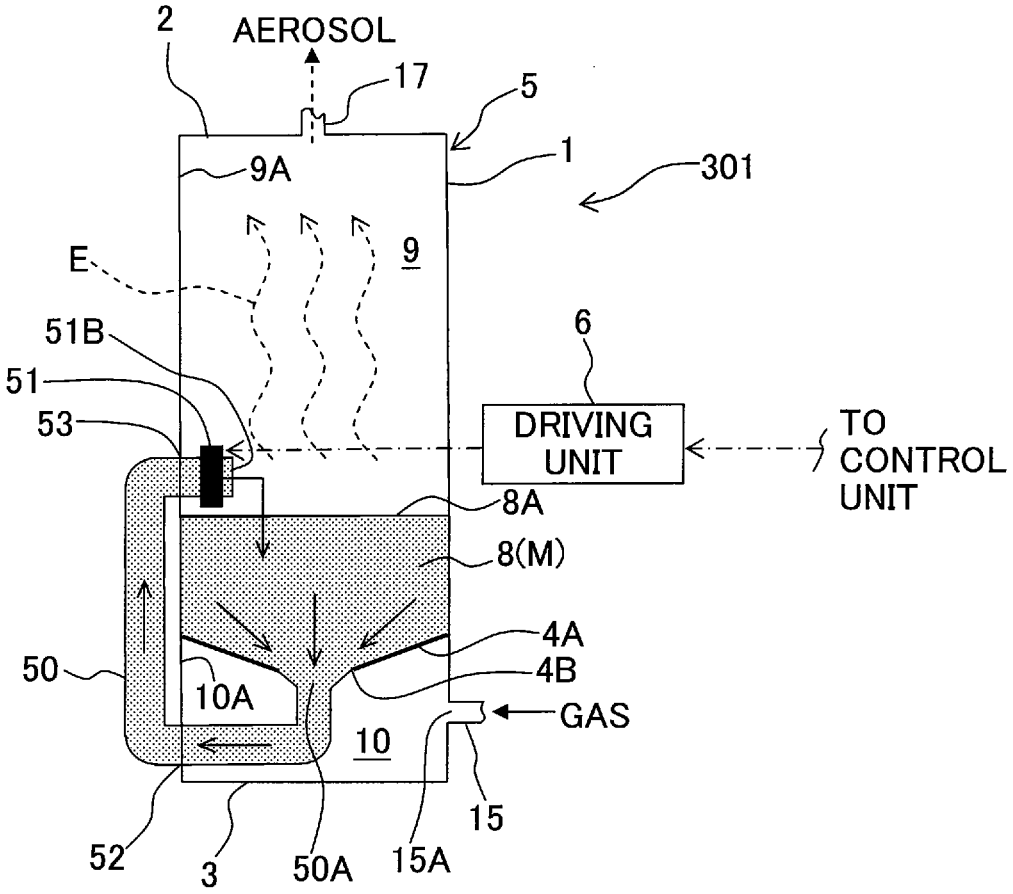
FIG. 3 schematically shows main components of an exemplary arrangement of an aerosol-generating apparatus according to a second embodiment of the present invention.

FIG. 3 schematically shows main components of an exemplary arrangement of an aerosol-generating apparatus according to a second embodiment of the present invention.

In the aerosol-generating apparatus 301 of this embodiment, the flow passage member 40 and the penetrating pore member 4 of the aerosol-generating apparatus 101 of the first embodiment are changed as follows.

As shown in FIG. 3, a funnel-shaped (hopper-shaped) penetrating pore member 4A is provided in the accommodating vessel 5 to compart the internal space thereof into two chambers. The upper space, which is included in the internal space of the accommodating vessel 5 and which is comparted by the penetrating pore member 4A, functions as the powder-accommodating chamber 9 to accommodate the powder 8 of the material particles M. The lower space functions as the carrier gas-introducing chamber 10 to introduce the carrier gas into the powder-accommodating chamber 9.

The penetrating pore member 4A has a large number of penetrating pores (not shown). The powder 8 of the material particles M is accommodated on the penetrating pore member 4A. The material and the particle size of the material particle M are the same as those described in the first embodiment. A discharge port 4B is formed at a central portion of the penetrating pore member 4A. The discharge port 4B is connected to an inlet opening 50A of a flow passage member 50 as described later on.

The flow passage member 50 constitutes the powder flow passage for transporting the powder 8. In this embodiment, the flow passage member 50 is a cylindrical piping made of resin (for example, made of acrylic resin). As shown in FIG. 3, the flow passage member 50 has a shape bent to be in a substantially U-shaped form, which is arranged so that the flow passage member 50 protrudes in the horizontal direction from the inside to the outside of the accommodating vessel 5. The flow passage member 50 has an upper intersecting section 53 which intersects the inner wall surface 9A at the portion disposed over or above the powder surface 8A, of the inner wall surface 9A of the powder-accommodating chamber 9, and a lower intersecting section 52 which intersects the inner wall surface 10A, at the portion disposed below the powder surface 8A, of the carrier gas-introducing chamber 10.

Therefore, a portion of the flow passage member 50, which ranges from the inlet opening 50A to the lower intersecting section 52, is arranged at the inside of the carrier gas-introducing chamber 10. Another portion of the flow passage member 50, which ranges from the upper intersecting section 53 to the outlet opening 50B, is arranged above the powder surface 8A at the inside of the powder-accommodating chamber 9. Still another portion of the flow passage member 50, which ranges from the lower intersecting section 52 to the upper intersecting section 53, is arranged at the outside of the accommodating vessel 5.

Thus, the flow passage member 50 has the inlet opening 50A which is positioned under or below the powder surface 8A of the powder 8, and the outlet opening 50B which is positioned over or above the powder surface 8A. The powder 8, which enters the flow passage member 50 from the inlet opening 50A, can be transported in the direction (upward direction) directed to the outlet opening 50B against the gravity in accordance with the action of the ultrasonic transport of the powder 8 effected by the piezoelectric vibrator 51.

In this embodiment, the piezoelectric vibrator 51, which generates the stationary wave and the progressive wave (ultrasonic wave) to be transmitted through the flow passage member 50, is attached in the vicinity of the outlet opening 50B of the flow passage member 50. Such a piezoelectric vibrator 51 may be attached in the vicinity of the inlet opening 50A of the flow passage member 50 as described in the first embodiment. Each one of the piezoelectric vibrators 51 may be attached to the vicinity of the inlet opening 50A of the flow passage member 50 and the vicinity of the outlet opening 50B of the flow passage member 50 respectively.

Owing to the construction as described above, the powder 8, which enters the flow passage member 50 from the inlet opening 50A of the flow passage member 50, is transported in the direction directed to the outlet opening 50B of the flow passage member 50 against the gravity in accordance with the action of the ultrasonic transport of the powder 8 effected by the piezoelectric vibrator 51. The powder 8 arrives at the falling position (outlet opening 50B in this embodiment). After that, the powder 8 falls toward the powder surface 8A in accordance with the self-weight from the falling position. On the other hand, the powder 8, which is disposed in the vicinity of the discharge port 4B of the penetrating pore member 4A, is sucked into the flow passage member 50 from the inlet opening 50A. In particular, the discharge port 4B is positioned in the lowermost layer at the center of the powder 8. The powder 8 disposed at this portion is sucked, which is preferred.

When the circulation type fluidization of the powder 8 is caused as described above, it is possible to form the fluidization layer in the powder 8.

When the powder 8 is fluidized so that the powder 8 is circulated, it is possible to appropriately reduce the aggregation of the material particles M even when the aerosol-generating apparatus 301 is used for a long period of time. In other words, in this embodiment, the following effect is obtained owing to the fluidization in the powder 8. That is, the aggregates of the material particles M are rubbed with each other, and the aggregates are pulverized. Further, in this embodiment, the following effect is obtained. That is, the powder 8 is allowed to fall by the self-weight from the falling position toward the powder surface 8A, and hence the aggregates of the material particles M can be pulverized by means of the falling energy brought about when the aggregates are allowed to fall by the self-weight. In this case, the distance in the height direction (difference in height of the powder 8) between the falling position and the powder surface 8A may be appropriately set in accordance with the comparison between the potential energy of the aggregates of the material particles M at the falling position and the aggregation energy exerted between the material particles M.

Owing to the pulverizing effect to pulverize the aggregates of the material particles M as described above, it is possible to stably produce the aerosol E over a long period of time by the aerosol-generating apparatus 301 (in other words, it is possible to obtain the constant concentration of the material particles M in the aerosol E over a long period of time).

Third Embodiment

Figure 4:
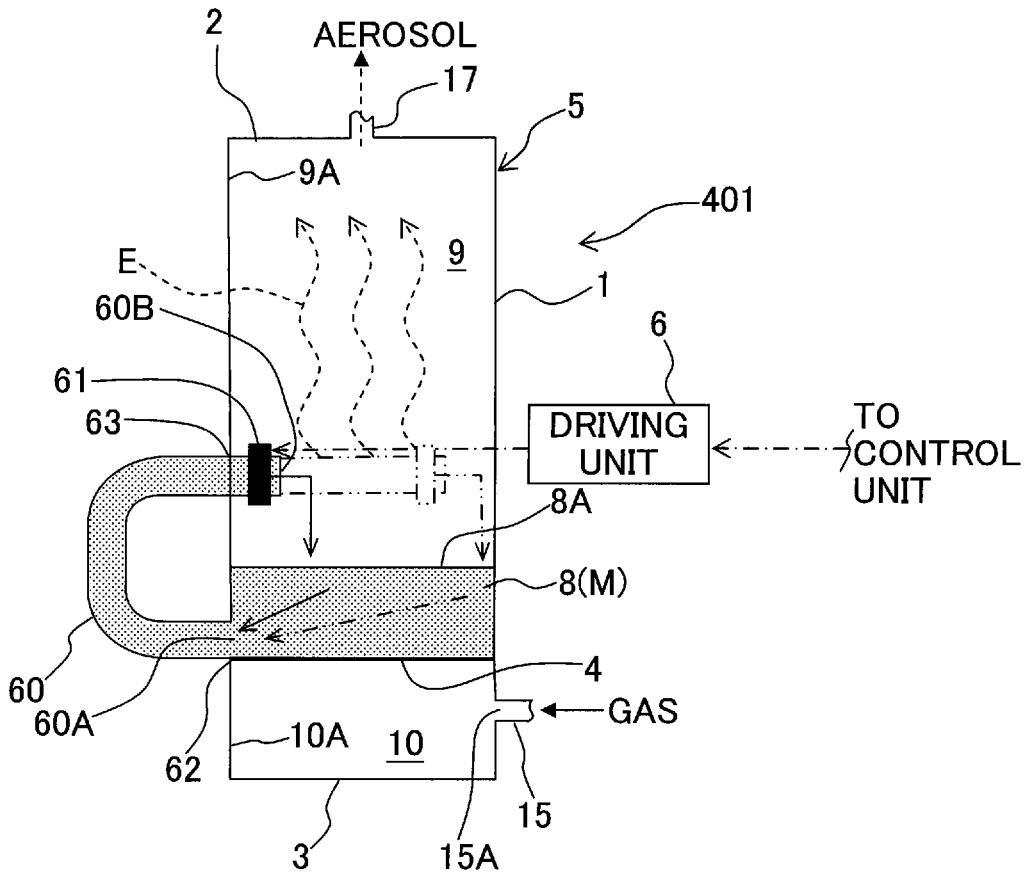
FIG. 4 schematically shows main components of an exemplary arrangement of an aerosol-generating apparatus according to a third embodiment of the present invention.

FIG. 4 schematically shows main components of an exemplary arrangement of an aerosol-generating apparatus according to a third embodiment of the present invention. The aerosol-generating apparatus 401 of this embodiment differs in that a flow passage member 60 thereof is changed as follows as compared with the flow passage member 40 of the aerosol-generating apparatus 101 of the first embodiment.

The flow passage member 60 of the aerosol-generating apparatus 401 constitutes the powder flow passage for transporting the powder 8. In this embodiment, the flow passage member 60 is a cylindrical piping made of resin (for example, made of acrylic resin). As shown in FIG. 4, the flow passage member 60 has a substantially U-shaped form, which is arranged so that the flow passage member 60 protrudes in the horizontal direction from the inside to the outside of the accommodating vessel 5. The flow passage member 60 has an upper intersecting section 63 which intersects the inner wall surface 9A at the portion disposed over or above the powder surface 8A. An inlet opening 60A of the flow passage member 60 is formed on the inner wall surface 9A at the portion disposed under or below the powder surface 8A.

Therefore, a portion of the flow passage member 60, which ranges from the upper intersecting section 63 to the outlet opening 60B, is arranged over or above the powder surface 8A at the inside of the powder-accommodating chamber 9. Another portion of the flow passage member 60, which ranges from the inlet opening 60A to the upper intersecting section 63, is arranged at the outside of the accommodating vessel 5.

Thus, the flow passage member 60 has the inlet opening 60A which is positioned under or below the powder surface 8A of the powder 8, and the outlet opening 60B which is positioned over or above the powder surface 8A. The powder 8, which enters the flow passage member 60 from the inlet opening 60A of the flow passage member 60, can be transported in the direction (upward direction) directed to the outlet opening 60B of the flow passage member 60 against the gravity in accordance with the action of the ultrasonic transport of the powder 8 effected by the piezoelectric vibrator 61. In this embodiment, as shown in FIG. 4, the inlet opening 60A of the flow passage member 60 is provided at the position closest to the upper surface of the penetrating pore member 4. Accordingly, the powder 8, which is disposed in the vicinity of the lowermost layer separated from (away from) the powder surface 8A, can be sucked from the inlet opening 60A of the flow passage member 60.

In this embodiment, the piezoelectric vibrator 61, which generates the stationary wave and the progressive wave (ultrasonic wave) to be transmitted through the flow passage member 60, is attached in the vicinity of the outlet opening 60B of the flow passage member 60. However, such a piezoelectric vibrator 61 may be attached in the vicinity of the inlet opening 60A of the flow passage member 60 in the same manner as in the first embodiment. Each one of the piezoelectric vibrators 61 may be attached to the vicinity of the inlet opening 60A of the flow passage member 60 and the vicinity of the outlet opening 60B of the flow passage member 60 respectively.

Owing to the construction as described above, the powder 8, which enters the flow passage member 60 from the inlet opening 60A of the flow passage member 60, is transported in the direction directed to the outlet opening 60B of the flow passage member 60 against the gravity in accordance with the action of the ultrasonic transport of the powder 8 effected by the piezoelectric vibrator 61. The powder 8 arrives at the falling position (outlet opening 60B in this embodiment). After that, the powder 8 falls toward the powder surface 8A in accordance with the self-weight from the falling position. On the other hand, the powder 8 is sucked into the flow passage member 60 from the inlet opening 60A of the flow passage member 60.

When the circulation type fluidization of the powder 8 is caused as described above, it is possible to form the fluidization layer in the powder 8.

When the powder 8 is fluidized so that the powder 8 is circulated, it is possible to appropriately reduce the aggregation of the material particles M even when the aerosol-generating apparatus 401 is used for a long period of time. In other words, in this embodiment, the following effect is obtained owing to the fluidization in the powder 8. That is, the aggregates of the material particles M are rubbed with each other, and the aggregates are pulverized. Further, in this embodiment, the following effect is obtained. That is, the powder 8 is allowed to fall by the self-weight from the falling position toward the powder surface 8A, and hence the aggregates of the material particles M can be pulverized by means of the falling energy brought about when the aggregates are allowed to fall by the self-weight. In this case, the distance in the height direction (difference in height of the powder 8) between the falling position and the powder surface 8A may be appropriately set in accordance with the comparison between the potential energy of the aggregates of the material particles M at the falling position and the aggregation energy exerted among the material particles M.

Owing to the pulverizing effect to pulverize the aggregates of the material particles M as described above, it is possible to stably produce the aerosol E over a long term by the aerosol-generating apparatus 401 (in other words, it is possible to obtain the constant concentration of the material particles M in the aerosol E over a long term).

Further, in this embodiment, the horizontal position of the outlet opening 60B of the flow passage member 60 is set as follows according to the relationship between the position of the inlet opening 60A and the angle of repose of the powder 8. The angle of repose refers to the angle of inclination formed with respect to the horizontal plane by the conical sedimentation layer generated by allowing the powder to quietly fall from the upper position onto the horizontal plane with a funnel or the like.

Figure 5:
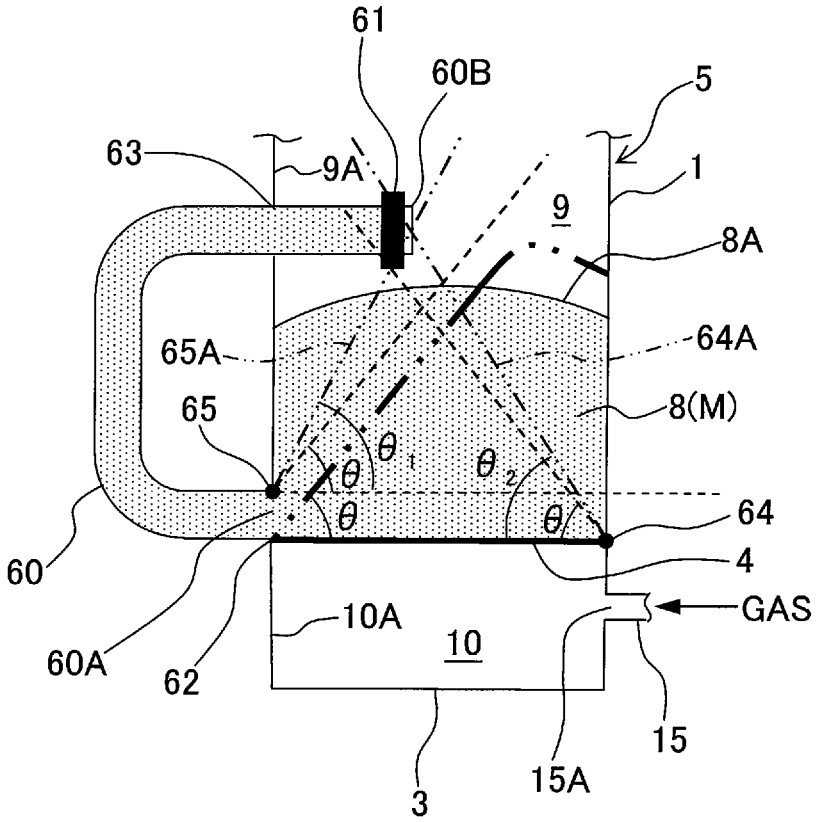
FIG. 5 illustrates a method for setting a horizontal position of an outlet opening of a flow passage member in the third embodiment.

FIG. 5 illustrates a method for setting the horizontal position of the outlet opening of the flow passage member.

At first, it is assumed that $\theta_2$ represents the angle formed with respect to the horizontal plane by the first imaginary line 64A to connect the center of the outlet opening 60B of the flow passage member 60 and the opposing position 64 of the inner wall surface 9A of the powder-accommodating chamber 9 opposed to the inlet opening 60A of the flow passage member 60 (that is, the lower end of the inlet opening 60A). It is preferable that the outlet opening 60B of the flow passage member 60 is separated from the inlet opening 60A of the flow passage member 60 so that the formed angle $\theta_2$ in this case is larger than the angle of repose $\theta$ (50 to 60° in this embodiment) of the powder 8 of the material particles M. Accordingly, as indicated by a thin two-dot chain line shown in FIG. 4, the powder 8 can be allowed to fall toward the powder surface 8A from the position sufficiently separated from the inlet opening 60A of the flow passage member 60. As a result, the powder 8 can be fluidized in a wide area while collapsing the wall of the powder 8 formed by the angle of repose $\theta$ at the opposing position 64.

On the other hand, it is assumed that $\theta_1$ represents the angle formed with respect to the horizontal plane by the second imaginary line 64B to connect the center of the outlet opening 60B of the flow passage member 60 and the upper end position 65 of the inlet opening 60A of the flow passage member 60. It is preferable that the outlet opening 60B of the flow passage member 60 is allowed to approach the inlet opening 60A of the flow passage member 60 so that the formed angle $\theta_1$ in this case is larger than the angle of repose $\theta$ of the powder 8 of the material particles M. Accordingly, as indicated by a thick two-dot chain line shown in FIG. 5, it is possible to avoid such a situation that the powder 8 does not arrive at the inlet opening 60A due to the wall of the powder 8 formed by the angle of repose $\theta$ at the inlet opening 60A, when the amount of the powder 8 is decreased as the powder 8 is progressively converted into the aerosol.

For the two reasons described above, as shown in FIG. 5, it is preferable that the horizontal position of the outlet opening 60B of the flow passage member 60 exists in the area which is disposed above the line (see a dotted line shown in FIG. 5) drawn in the direction of the angle of repose $\theta$ from the opposing position 64 and which is disposed above the line (see a dotted line shown in FIG. 5) drawn in the direction of the angle of repose $\theta$ from the upper end position 65.

The angle of repose $\theta$ of the powder 8 described above can be measured, for example, by using any appropriate device for measuring the angle of repose in accordance with Japanese Industrial Standards (JIS) before the material particles M are introduced into the accommodating vessel 5.

First Modified Embodiment

Figure 6:
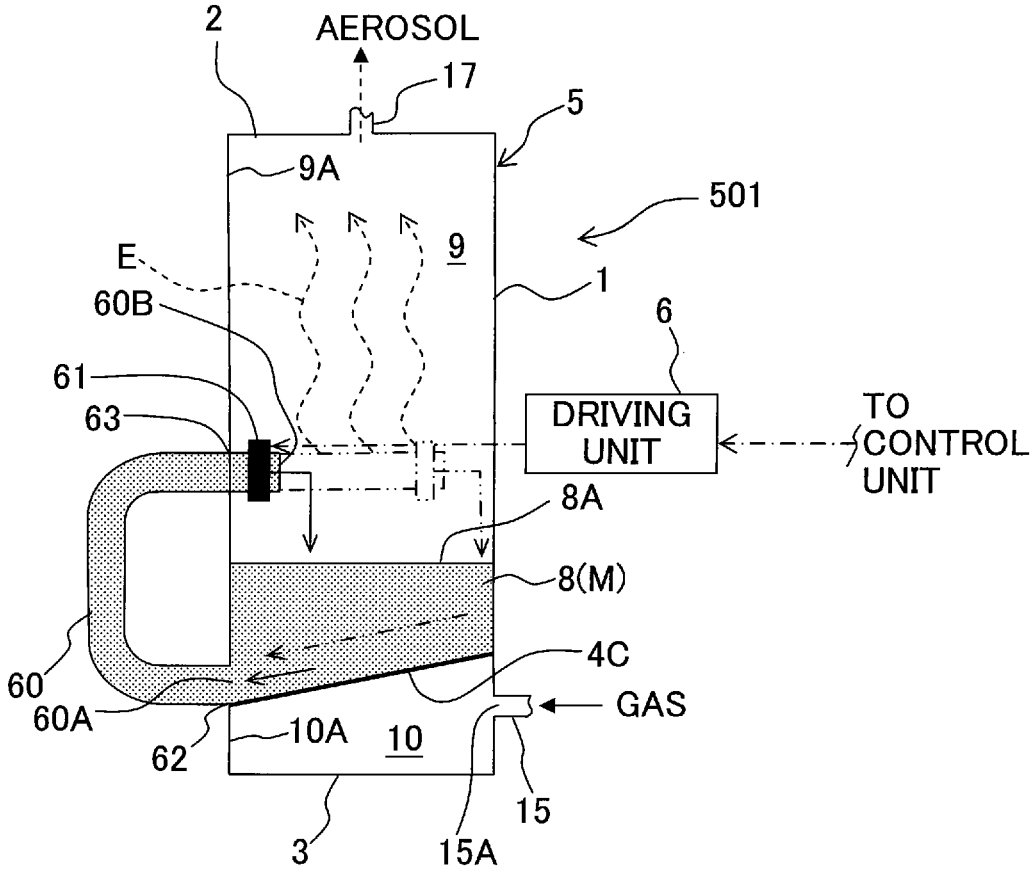
FIG. 6 schematically shows main components of an exemplary arrangement of an aerosol-generating apparatus according to a first modified embodiment concerning the third embodiment.

An explanation will be made about a modified embodiment in which the arrangement of the penetrating pore member 4 of the aerosol-generating apparatus 401 of the third embodiment is modified. FIG. 6 schematically shows main components of an exemplary arrangement of an aerosol-generating apparatus according to a first modified embodiment concerning the third embodiment.

As shown in FIG. 6, a plate-shaped penetrating pore member 4C is provided in the accommodating vessel 5 of the aerosol-generating apparatus 501 so that the internal space is comparted into two chambers. The upper space, which is included in the internal space of the accommodating vessel 5 and which is comparted by the penetrating pore member 4C, functions as the powder-accommodating chamber 9 for accommodating the powder 8 of the material particles M. The lower space functions as the carrier gas-introducing chamber 10 for introducing the carrier gas into the powder-accommodating chamber 9.

The penetrating pore member 4C is formed with a large number of through-holes (not shown). The powder 8 of the material particles M is accommodated on the penetrating pore member 4C. The material and the particle diameter of the material particle M are the same as the contents described in the first embodiment.

The penetrating pore member 4C is inclined, and hence the powder 8 of the material particles M is moved toward the inlet opening 60A of the flow passage member 60 in accordance with the self-weight thereof. Accordingly, the powder 8, which is disposed at any position separated from the inlet opening 60A, can be moved to the inlet opening 60A by means of the self-weight of the powder 8.

Second Modified Embodiment

Figure 7:
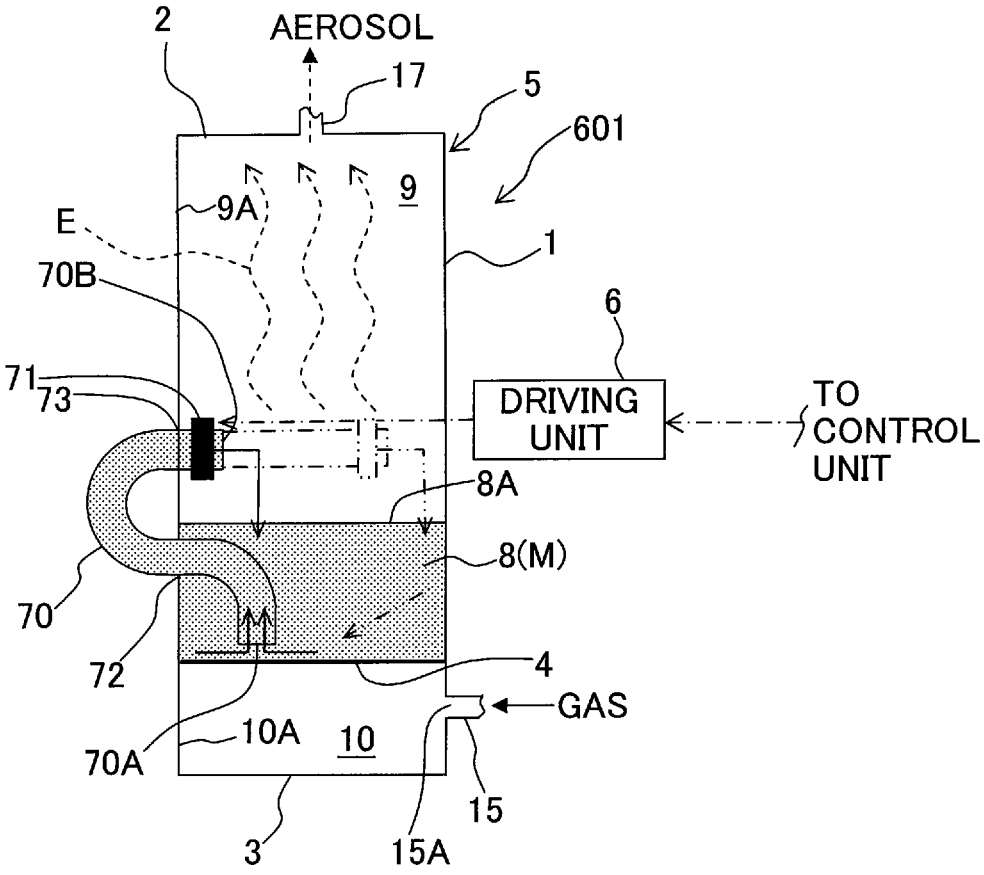
FIG. 7 schematically shows main components of an exemplary arrangement of an aerosol-generating apparatus according to a second modified embodiment concerning the third embodiment.

FIG. 7 schematically shows main components of an exemplary arrangement of an aerosol-generating apparatus according to a second modified embodiment concerning the third embodiment. According to the aerosol-generating apparatus 601 of this modified embodiment, a flow passage member 70 of the aerosol-generating apparatus 601 is constructed on the basis of the combination of the design of the flow passage member 60 of the aerosol-generating apparatus 401 of the third embodiment and the design of the flow passage member 40 of the aerosol-generating apparatus 101 of the first embodiment.

In this embodiment, the inlet opening 70A of the flow passage member 70 is positioned while being deviated toward the center of the powder 8 as compared with the aerosol-generating apparatus 401 of the third embodiment. The inlet opening of the flow passage member is arranged at the subsequently central portion of the accommodating vessel, and hence the powder 8 can be circulated so that the entire powder 8 is agitated, as compared with the case in which the inlet opening of the flow passage member is arranged at the end of the accommodating vessel. It is unnecessary to provide the discharge port 4B for the penetrating pore member 4A unlike the second embodiment (FIG. 3), which is advantageous in view of the easiness of the fabrication of the penetrating pore member.

The flow passage member 70 of the aerosol-generating apparatus 601 constitutes the powder flow passage for transporting the powder 8. In this arrangement, the flow passage member 70 is a cylindrical piping made of resin (for example, made of acrylic resin).

As shown in FIG. 7, the flow passage member 70 has a portion which is bent in a substantially L-shaped form and which is embedded in the powder 8 accommodated in the powder-accommodating chamber 9, and another portion which is bent in a substantially U-shaped form and which protrudes in the horizontal direction from the inside to the outside of the accommodating vessel 5. In other words, the flow passage member 70 has a lower intersecting section 72 which intersects the inner wall surface 9A at the portion disposed below the powder surface 8A at the inner wall surface 9A of the powder-accommodating chamber 9. Further, the flow passage member 70 has an upper intersecting section 73 which intersects the inner wall surface 9A at the portion disposed above the powder surface 8A at the inner wall surface 9A of the powder-accommodating chamber 9.

Therefore, a portion of the flow passage member 70, which ranges from the upper intersecting section 73 to the outlet opening 70B, is arranged above the powder surface 8A at the inside of the powder-accommodating chamber 9. Another portion of the flow passage member 70, which ranges from the lower intersecting section 72 to the inlet opening 70A, is embedded in the powder 8. Still another portion of the flow passage member 70, which ranges from the lower intersecting section 72 to the upper intersecting section 73, is arranged at the outside of the internal space of the accommodating vessel 5.

Thus, the flow passage member 70 has the inlet opening 70A which is formed below the powder surface 8A of the powder 8, and the outlet opening 70B which is formed above the powder surface 8A. The powder 8, which enters the flow passage member 70 from the inlet opening 70A, can be transported in the direction (upward direction) directed to the outlet opening 70B of the flow passage member 70 against the gravity in accordance with the action of the ultrasonic transport of the powder 8 effected by the piezoelectric vibrator 71. On the other hand, the powder 8 is sucked into the flow passage member 70 from the inlet opening 70A. In particular, the inlet opening 70A of the flow passage member 70 is positioned in the vicinity of the lowermost layer in the powder 8 accommodated in the powder-accommodating chamber 9. Therefore, the powder 8 can be sucked upwardly from this portion.

Fourth Embodiment

Figure 8:
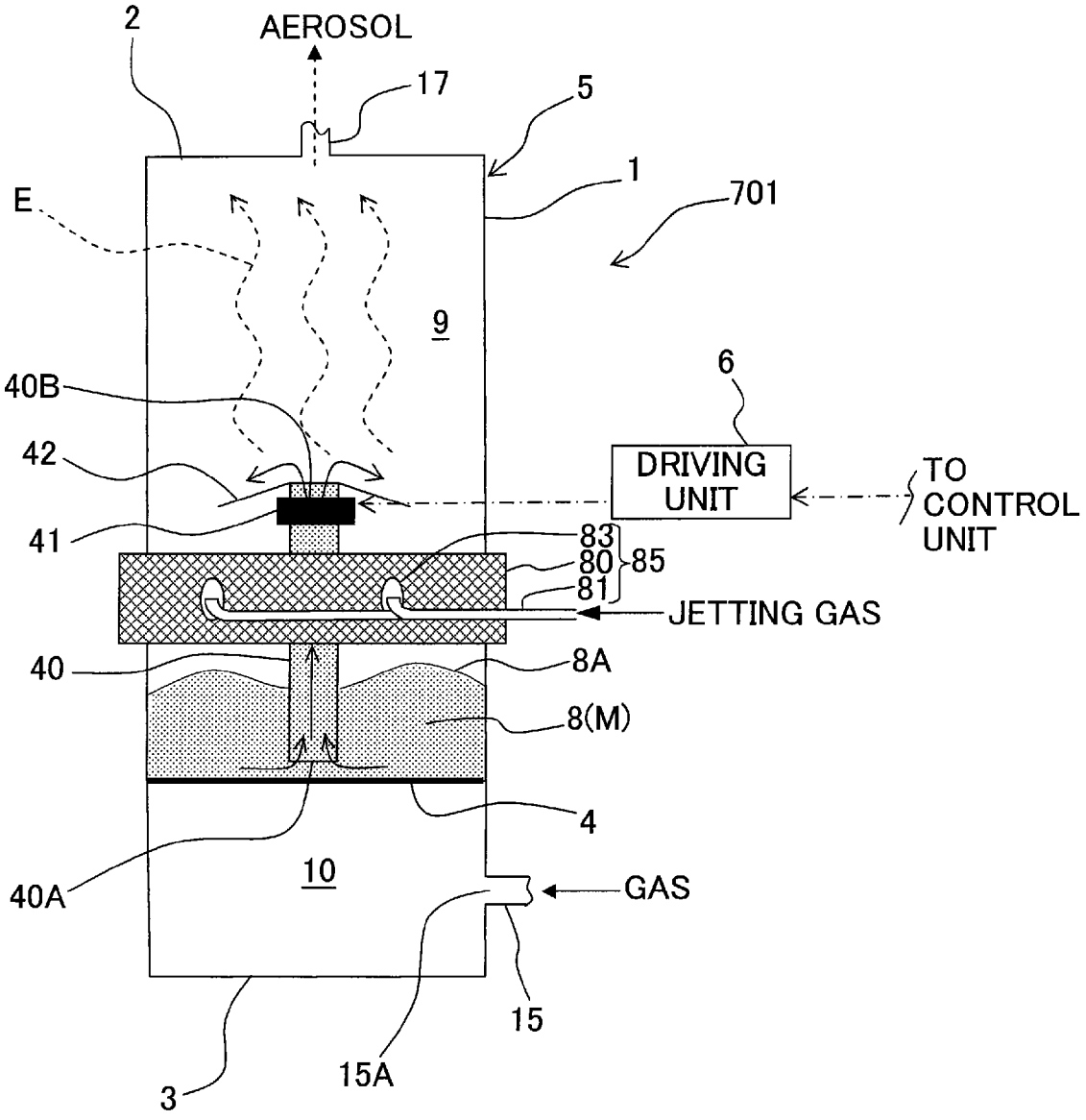
FIG. 8 schematically shows main components of an exemplary arrangement of an aerosol-generating apparatus according to a fourth embodiment of the present invention.
Figure 9:
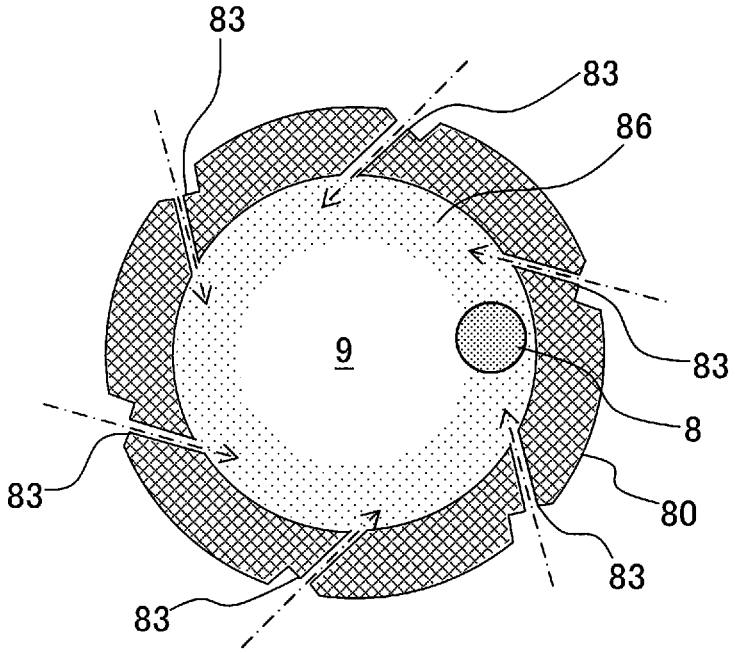
FIG. 9 shows a magnified plan view illustrating the interior of a powder-accommodating chamber of the aerosol-generating apparatus shown in FIG. 8 as viewed from an upper position.

FIG. 8 schematically shows main components of an exemplary arrangement of an aerosol-generating apparatus according to a fourth embodiment of the present invention. FIG. 9 shows the interior of a powder-accommodating chamber of the aerosol-generating apparatus shown in FIG. 8 as viewed in a plan view in the vertical direction. However, in FIG. 9, a jet gas-introducing piping 81 (described later on) and a circulating fluidization mechanism are omitted from the illustration.

According to the aerosol-generating apparatus 701 of this embodiment, the following jet mill 85 is added to the aerosol-generating apparatus 101 of the first embodiment.

The jet mill 85 (gas-jetting mechanism) of the aerosol-generating apparatus 701 is provided with a cylindrical main jet mill body 80.

As shown in FIGS. 8 and 9, the main jet mill body 80 is provided with six jet nozzles (gas-jetting ports) 83 for jetting the gas, the jet nozzles (gas-jetting ports) 83 being disposed at equal intervals in the circumferential direction of the main jet mill body 80. The jet gas-introducing piping 81, which is provided to introduce the high pressure gas (specifically the gas of the same type as that of the carrier gas described above) into the jet nozzles 83, is communicated with the jet nozzles 83.

As shown in FIG. 9, any one of the six jet nozzles 83 described above has its gas-jetting direction which is inclined in the clockwise direction at an identical angle with respect to the radius vector direction of the main jet mill body 80. Accordingly, a swirling flow of the gas can be generated in the main jet mill body 80. As a result, it is possible to form an annular jetting area 86.

In this arrangement, the falling position of the powder 8 (position of the end of the umbrella-shaped plate 42) described in the first embodiment is set in relation to the jetting area 86. In other words, the jet nozzles 83 are set in relation to the falling route of the powder 8 allowed to fall from the outlet opening 40B of the flow passage member 40 via the umbrella-shaped plate 42. Specifically, as shown in FIG. 9, the falling route makes the intersection at the predetermined point in the jetting area 86. The point may be disposed at any position provided that the point is disposed in the jetting area 86. However, it is preferable that the point exists on any extended line in the gas-jetting direction of the jet nozzle 83.

Accordingly, the super high speed gas, which is jetted from the jet nozzles 83, is allowed to collide with the powder 8 during the falling toward the powder surface 8A in the jetting area 86. The aggregates of the material particles M are pulverized and the material particles M are broken (i.e., the material particles M are crushed into fragments thereof) in accordance with the collision among the aggregates of the material particles M, the collision among the material particles M, and/or the collision between the aggregates of the material particles M and the material particles M.

When the jetting pressure of the gas jetted from the jet nozzles 83 is appropriately weakened, it is possible to execute only the pulverization of the aggregates of the material particles M. In this case, the jetting area 86 described above functions as the pulverizing area for the aggregates of the material particles M. When the jetting pressure of the gas jetted from the jet nozzles 83 is appropriately strengthened, it is possible to execute both of the pulverization of the aggregates of the material particles M and the breakage of the material particles M. In this case, the jetting area 86 functions as the pulverizing area for the aggregates of the material particles M and the breaking area for the material particles M.

Owing to the construction as described above, the powder 8, which enters the flow passage member 40 from the inlet opening 40A, is transported in the direction directed to the outlet opening 40B of the flow passage member 40 against the gravity in accordance with the action of the ultrasonic transport of the powder 8 effected by the piezoelectric vibrator 41. The powder 8 arrives at the falling position described above. After that, the powder 8 falls toward the powder surface 8A in accordance with the self-weight from the falling position. In this situation, the powder 8, which is being subjected to the falling toward the powder surface 8A, is pulverized or broken in the jetting area 86 (S5 in FIG. 17). When the powder 8, which is being subjected to the falling toward the powder surface 8A, is sufficiently made fine, then the powder 8 does not fall onto the powder surface 8A, and the powder 8 is converted into the aerosol by the carrier gas. On the other hand, the powder 8, which is being subjected to the falling toward the powder surface 8A, is insufficiently made fine, the powder 8 falls onto the powder surface 8A.

Owing to the breaking effect exerted on the material particles M and the pulverizing effect exerted on the aggregates of the material particles M in the jetting area 86 of the powder 8 as described above, it is possible to stably produce the aerosol E by the aerosol-generating apparatus 101 over a long period of time (i.e., it is possible to provide the constant concentration of the material particles M in the aerosol E over a long period of time). In particular, in this embodiment, it is also possible to appropriately break the material particles M in addition to the pulverization of the aggregates of the material particles M. Therefore, in the aerosol-generating apparatus 701 of this embodiment, even when the material particles M, which are allowed to stay in the powder 8, have the large particle sizes to such an extent that the material particles M are not suitable to form the aerosol, the material particles M can be broken so that the material particles M are suitable to form the aerosol, owing to the cooperation with the circulation type fluidization of the powder 8 as described above. It is possible to produce the aerosol E continuously until the powder 8 is used up or completely used, without taking out the powder 8 to the outside by opening the accommodating vessel 5.

Further, in this embodiment, the concentration of the material particles M in the aerosol E can be adjusted by the jetting pressure of the gas to be jetted from the jet nozzles 83 and the amount of the powder 8 to be circulated in accordance with the circulation type fluidization.

Figure 10:
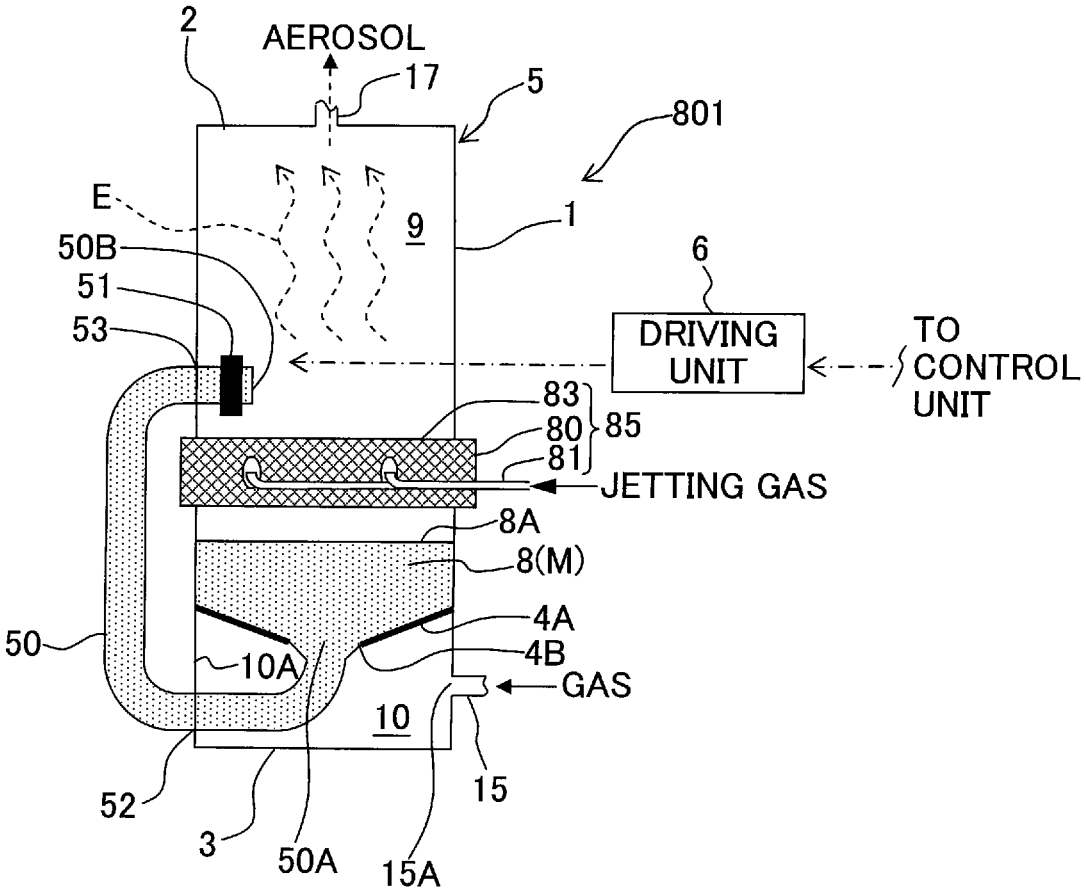
FIG. 10 schematically shows main components of another exemplary arrangement of an aerosol-generating apparatus according to the fourth embodiment of the present invention.

As shown in FIG. 10, the jet mill 85 may be added to the aerosol-generating apparatus 301 of the second embodiment. The aerosol-generating apparatus 801 of this arrangement exhibits the same effect as that described above by appropriately setting the falling position of the powder 8 (outlet opening 50B of the flow passage member 50 in this case) in relation to the jetting area 86 as described above. Similarly, the jet mill can be added to the aerosol-generating apparatus in any one of the embodiments and the modified embodiments described above.

Modified Embodiment for Transport Mechanism for Powder 8

The embodiments described above are illustrative of the case wherein the piezoelectric vibrator, which generates the ultrasonic wave by utilizing the electrostrictive effect, is exemplified as the transport mechanism for transporting the powder 8 accommodated in the flow passage member in the direction directed from the inlet opening to the outlet opening of the flow passage member against the gravity. However, such a transport mechanism is not limited to the piezoelectric vibrator. For example, the transport mechanism may be any other vibrator for generating the ultrasonic wave (for example, a vibrator based on the use of the magnetostrictive effect) in place of the piezoelectric vibrator. Alternatively, the transport mechanism may be an actuator based on the use of the transport principle for the powder other than the ultrasonic transport (for example, a diaphragm pump or a screw feeder). As illustrated in the fifth embodiment described later on, it is also allowable that any other transport mechanism other than the ultrasonic transport (for example, a diaphragm pump, a screw feeder, or a uniaxial eccentric pump) may be incorporated into the aerosol-generating apparatus as described in the foregoing embodiments.

Modified Embodiment for Gas Supply Mechanism for Supplying Gas to Accommodating Vessel The embodiments described above are illustrative of the case wherein the carrier gas piping 15, which is communicated with the carrier gas-introducing chamber 10 of the accommodating vessel 5, is exemplified as the gas supply piping of the carrier gas supply mechanism for supplying the carrier gas to the accommodating vessel 5. However, such a supply piping for the carrier gas may be a piping (communicating piping) which makes communication between the gas cylinder 11 and the powder-accommodating chamber 9 of the accommodating vessel 5. In other words, a connecting port may be formed for the powder-accommodating chamber 9 of the accommodating vessel, and the piping of the carrier gas may be connected to the connecting port of the powder-accommodating chamber 9. Alternatively, the aerosol-generating apparatus of this modified embodiment may be provided with both of the carrier gas piping 51 described above (see FIG. 1) which is communicated with the carrier gas-introducing chamber 10 of the accommodating vessel 5 and the communicating piping described above which makes communication between the gas cylinder 11 and the powder-accommodating chamber 9 of the accommodating vessel 5.

Specifically, the communicating piping passes along the connecting port provided for the first lid member 2 of the accommodating vessel 5 to extend downwardly in the powder-accommodating chamber 9. The forward end opening of the communicating piping for discharging the carrier gas is positioned above the penetrating pore member below the powder surface 8A (in the powder 8). A mass flow controller (flow rate controller) is provided at an intermediate portion of the communicating piping.

An appropriate amount of the gas, which is discharged from the gas cylinder 11, is supplied as the carrier gas via the communicating piping into the powder 8 accommodated in the powder-accommodating chamber 9 of the accommodating vessel 5. When an appropriate collective piping, which makes communication between the communicating piping and the carrier gas piping 15, is used, it is possible to furnish the supply of the gas allowed to flow through the communicating piping and the gas allowed to flow through the carrier gas piping 15 by means of one gas cylinder 11.

Modified Embodiment for Accommodating Vessel of Aerosol-Generating Apparatus

The embodiments described above are illustrative of the arrangement wherein the aerosol piping 17 is laid out between the accommodating vessel 5 and the jet nozzle 19 to connect the both by means of the aerosol piping 17. However, this arrangement is an example. The accommodating vessel 5 can be modified to have various forms. For example, an accommodating vessel, which is integrated with the jet nozzle 19, may be incorporated into the film-forming chamber 30. In this arrangement, a portion of the film-forming chamber 30 which functions as the powder-accommodating chamber for accommodating the powder 8 of the material particles M and another portion of the film-forming chamber 30 which functions as the carrier gas-introducing chamber correspond to the main body of the aerosol-generating apparatus.

EXAMPLE

Figure 11:
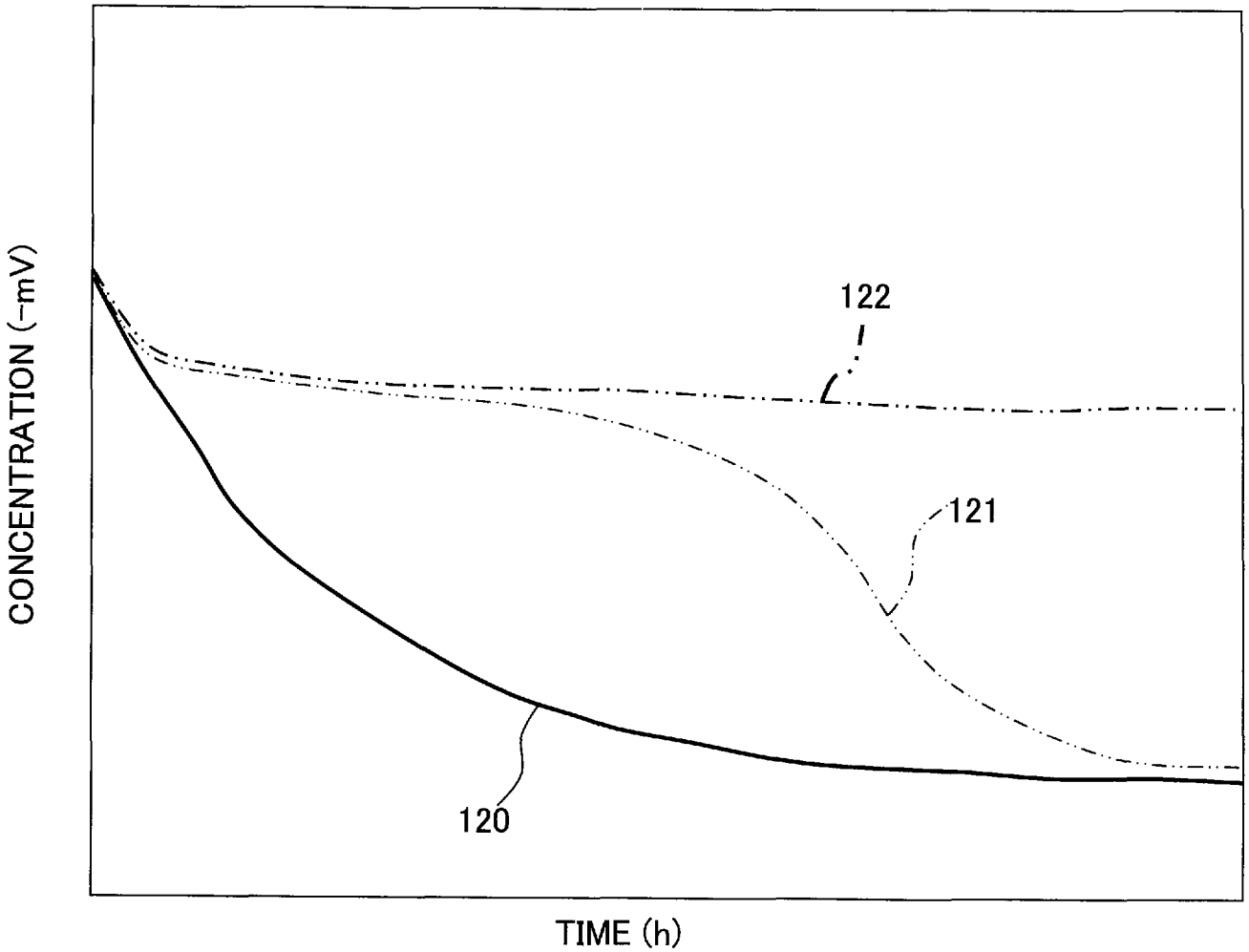
FIG. 11 illustrates the aerosol stable supply effect exhibited on the basis of the circulation type fluidization of the powder described in the first embodiment and the aerosol stable supply effect exhibited on the basis of the combination of the circulation type fluidization of the powder described in the fourth embodiment and the gas jetting directed to the powder as effected by a jet mill.

FIG. 11 illustrates the aerosol stable supply effect exhibited on the basis of the circulation type fluidization of the powder described in the first embodiment and the aerosol stable supply effect exhibited on the basis of the combination of the circulation type fluidization of the powder and the gas jetting directed to the powder as effected by the jet mill described in the fourth embodiment.

The horizontal axis of FIG. 11 represents the elapsed time (h) elapsed from the start of the generation of the aerosol by the aerosol-generating apparatus. The vertical axis of FIG. 11 represents the concentration of the material particles M in the aerosol E produced by the aerosol-generating apparatus. The vertical axis actually represents the electric potential (−mV) of the substrate 20 (see FIG. 1). It is assumed that the change of the electric potential represents the magnitude of the electric energy generated when the material particles M collide with the substrate 20. Therefore, it is considered that the change of the electric potential represents the value which is correlated with the number (concentration) of the material particles M. In other words, the graph shown in FIG. 11 depicts the fact that the concentration of the material particles M in the aerosol E is higher at upper portions of the vertical axis of the graph.

The profile 120, which is depicted by a solid line in FIG. 11, is the line obtained by connecting plots of actually measured data when both of the circulation type fluidization of the powder 8 and the jetting of the jet gas to the powder 8 are not executed. On the contrary, the profile 121, which is depicted by a thin two-dot chain line shown in FIG. 11, is the line which represents the tendency to be assumed when only the circulation type fluidization of the powder 8 is executed. The profile 122, which is depicted by a thick two-dot chain line in FIG. 11, is the line which represents the tendency to be assumed when both of the circulation type fluidization of the powder 8 and the jetting of the gas to the powder 8 by the jet mill 85 are executed.

As shown in FIG. 11, it is expected in the profile 121 that the period of time, in which the material particles M in the aerosol E are stably supplied (i.e., the concentration of the material particles M is constant), can be prolonged appropriately, as compared with the profile 120. It is expected in the profile 122 that the period of time, in which the concentration of the material particles M in the aerosol E resides in the stable supply (i.e., the concentration of the material particles M is constant), can be further prolonged appropriately and sufficiently as compared with the profile 121. According to an experiment performed by the present inventors, when both of the circulation type fluidization of the powder 8 and the jetting of the jet gas to the powder 8 were not executed as in the profile 120, the concentration of the material particles M was lowered by about 5 to 10 minutes to such an extent that the aerosol was incapable of being supplied stably. On the contrary, when the circulation type fluidization of the powder 8 was performed as in the profile 121, the concentration of the material particles M was successfully maintained for about several hours to such an extent that the aerosol was successfully supplied stably. Further, when both of the circulation type fluidization of the powder 8 and the gas jetting by the jet mill 85 to the powder 8 were executed as in the profile 122, the concentration of the material particles M was successfully maintained for not less than several tens hours to such an extent that the aerosol was successfully supplied stably.

Fifth Embodiment

It is preferable that the aerosol-generating apparatus as described above is constructed so that various types of powders 8 (material particles M) can be transported. However, the material particles M are sedimented or deposited, for example, on the inner wall of the flow passage member for forming the powder flow passage, depending on the characteristic of the material particles M (for example, easy aggregation of the material particles) in some cases. If the material particles M are sedimented on the inner wall of the flow passage member, the flow passage member is clogged up by the powder 8. As a result, it is difficult to maintain the constant transport amount of the powder 8, and it is impossible to transport the powder 8 in the worst case.

In particular, when it is impossible to sufficiently secure the transport amount to effect the circulation of the powder 8 by means of only the ultrasonic transport of the powder 8, any other transport mechanism (for example, a diaphragm pump, a screw feeder, or a uniaxial eccentric pump) other than the ultrasonic transport can be incorporated into the aerosol-generating apparatus as described in the embodiments described above. In this case, the material particles M are also sedimented, for example, on the blade of the screw of the screw feeder, and the flow passage member may be further highly possibly clogged up by the powder 8. The problem of the sedimentation of the material particles on the screw feeder is pointed out, for example, in Japanese Patent Application Laid-open No. 9-253476.

In view of the above, the aerosol-generating apparatus of this embodiment is constructed such that the inconvenience as described above can be appropriately dealt with, and various types of powders 8 (material particles M) can be transported.

Figure 12A:
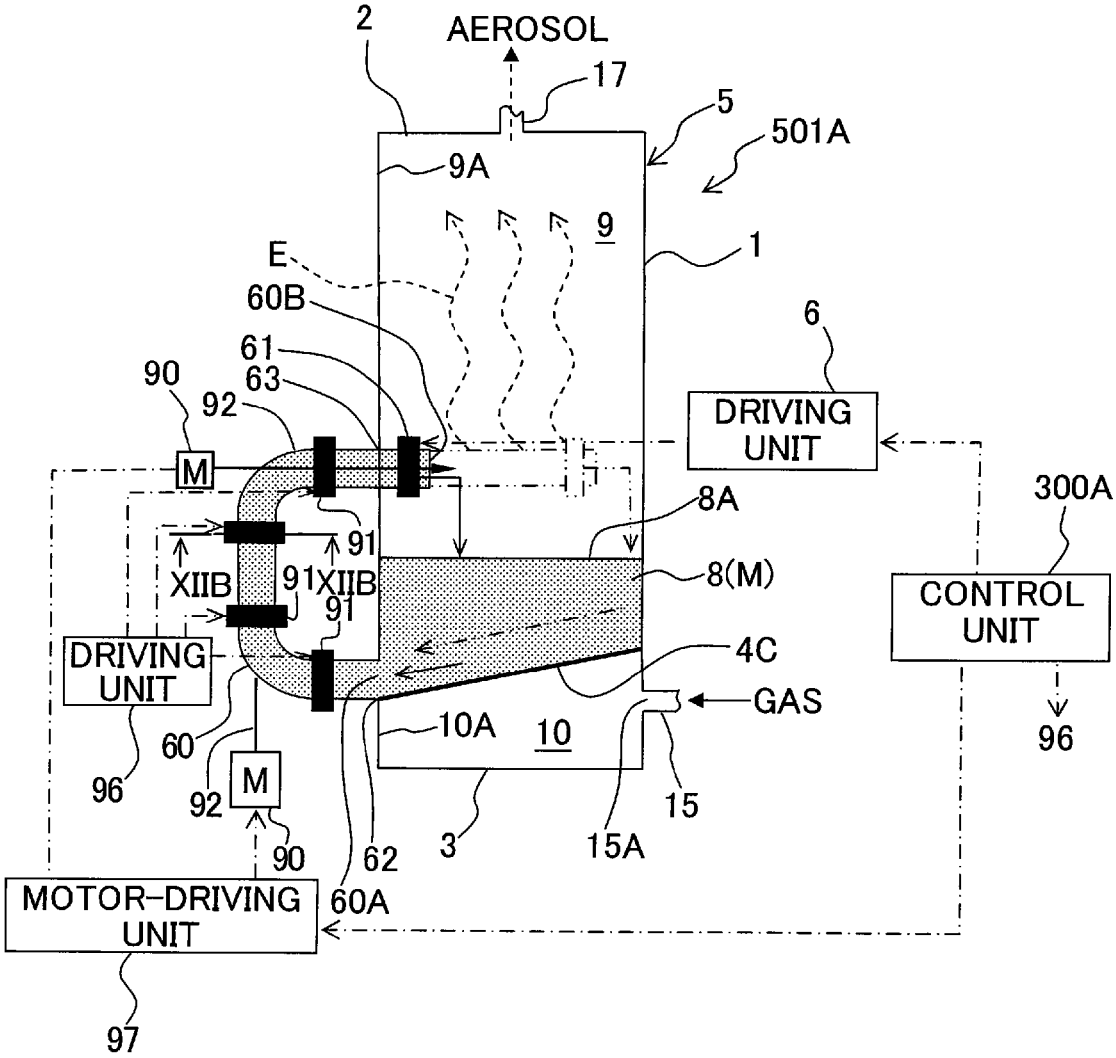
FIG. 12A schematically shows main components of an exemplary arrangement of an aerosol-generating apparatus according to a fifth embodiment of the present invention.
Figure 12B:
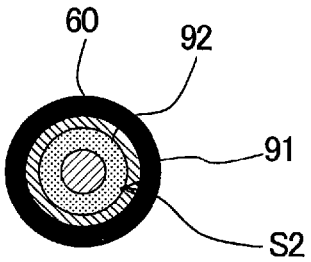
FIG. 12B shows a sectional view taken along a line XIIB-XIIB shown in FIG. 12A.

FIG. 12 schematically shows main components of an exemplary arrangement of an aerosol-generating apparatus according to the fifth embodiment of the present invention. The aerosol-generating apparatus 501A shown in FIG. 12 is illustrative of the exemplary case in which a screw 92 of a screw feeder is incorporated into the flow passage member 60 of the aerosol-generating apparatus 501 shown in FIG. 6.

The screw 92 of the screw feeder is constructed to have a rod-shaped form having a large number of blades or one helical blade. The screw 92 is rotatable about the axis in accordance with the rotary driving force of a driving motor 90. When the number of revolutions of the screw 92 is changed, then it is possible to appropriately adjust the transport amount of the powder 8, and it is possible to appropriately secure the transport amount in order to circulate the powder 8. The straight portion of the flow passage member 60 corresponds to a casing section of the screw 92.

As shown in FIG. 12, the aerosol-generating apparatus 501A of this embodiment is arranged with vibrators 91 which are capable of applying predetermined vibration to appropriate portions of the flow passage member 60. When the vibration condition of the vibrator 91 is appropriately set, it is possible to enhance the fluidity of the powder 8 in the flow passage member 60. It is considered that the sedimentation of the powder 8, which would be otherwise caused, for example, on the inner wall of the flow passage member 60, can be appropriately avoided. A specified method for setting the vibration condition of the vibrator 91 will be described later on.

As shown in FIG. 12, a control unit 300A adjusts the output of the piezoelectric vibrator 61 for the ultrasonic transport by using the driving unit 6. Further, the control unit 300A adjusts the output of the vibrator 91 for avoiding the sedimentation of the powder by using the driving unit 96. The control unit 300A is capable of adjusting the output of the driving motor 90 by using the motor-driving unit 97. Accordingly, the number of revolutions of the screw 92 is controlled.

Next, an explanation will be made about the method for setting the vibration condition of the vibrator 91. In this case, the maximum acceleration, which relates to the vibration of the vibrator 91 as described later on, is used as the vibration condition of the vibrator 91.

Figure 13A:
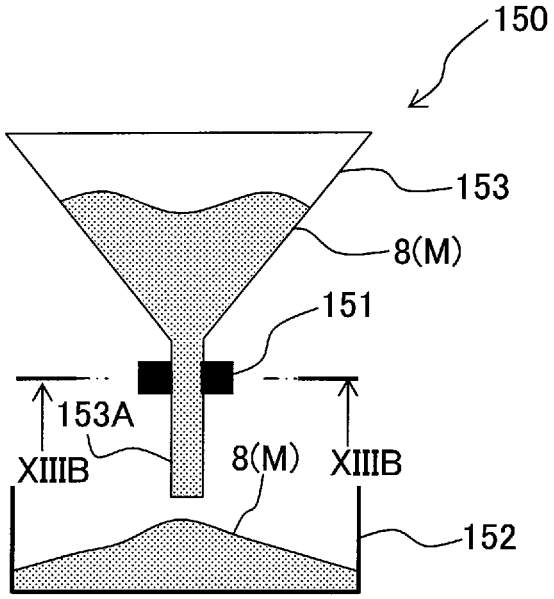
FIG. 13A schematically shows the outline of a vibration test machine in order to determine the maximum acceleration brought about by the vibration of a vibrator for preventing the powder sedimentation.
Figure 13B:
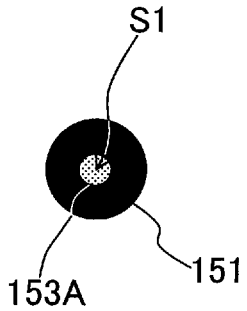
FIG. 13B shows a sectional view taken along a line XIIIB-XIIIB shown in FIG. 13A.

FIG. 13 schematically shows the outline of a vibration test machine in order to determine the maximum acceleration brought about by the vibration of the vibrator for preventing the powder sedimentation.

As shown in FIG. 13, the vibration test machine 150 is provided with a hopper 153 which accommodates the powder 8 (material particles M) to be used in the aerosol-generating apparatus 501A, and a receiving tray 152 which stores the powder 8 when the powder 8 is allowed to flow downwardly from the hopper 153.

The receiving tray 152 is supported by an appropriate weight-measuring device (not shown). The flow rate (number of gram or grams per unit time) of the powder 8, which is obtained when the powder 8 is allowed to flow downwardly from the hopper 153 in the vertical direction, is measured by the weight-measuring device.

As shown in FIG. 13, the hopper 153 is provided with a circular tube section (tube member, cylindrical member) 153A which has the columnar space formed therein. The cross-sectional area S1 of the circular tube section 153A (cross-sectional area of the portion to which the vibrator 151 is attached as shown in a sectional view taken along XIIIB-XIIIB line shown in FIG. 13A in this embodiment) has such a size to cause a clogging of the powder 8 in the circular tube section 153A, that is, the cross-sectional area S1 of the circular tube section 153A has such a size that the layer of the powder 8 disposed upwardly is supported in accordance with the clogging action of the powder 8 at the circular tube section 153A to cause the phenomenon in which the outflow of the powder 8 is stopped, when the powder 8 is allowed to outflow from the bottom of the hopper 153 in accordance with the gravity.

It is noted that the following fact is generally known about the clogging of the powder 8 described above. That is, as shown in FIG. 13A, when the vibrator 151 is attached to the circular tube section 153A, and the vibration of not less than a certain level is applied to the circular tube section 153A, then it is possible to collapse the clogging of the powder 8.

Figure 14:
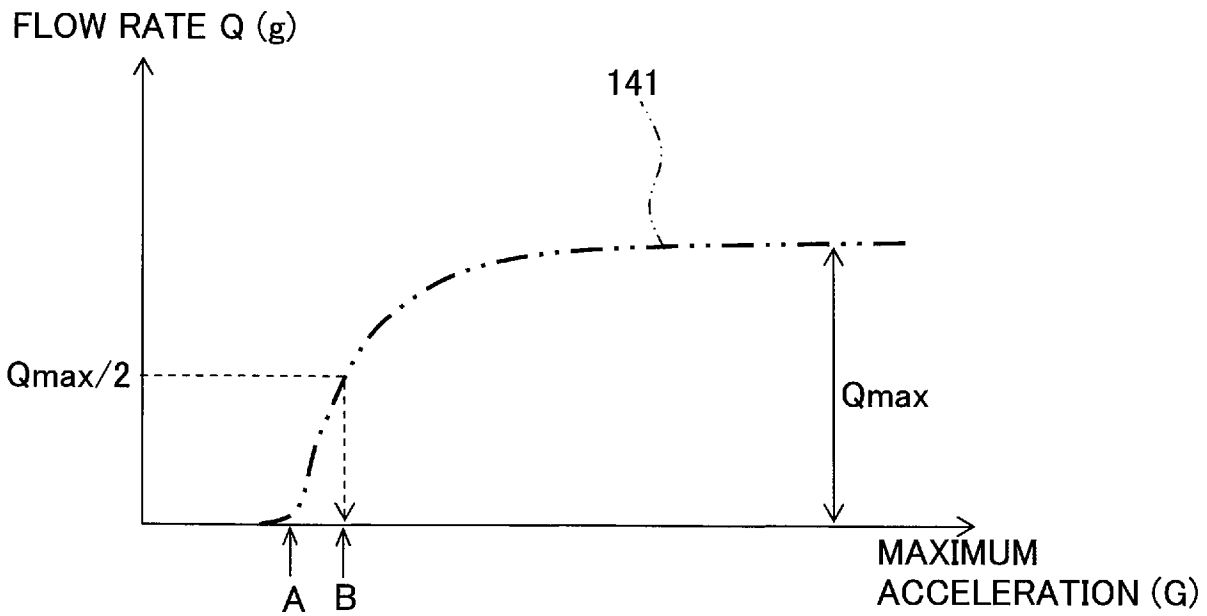
FIG. 14 shows a forecast tendency of a flow rate profile of the powder as obtained by using the vibration test machine shown in FIG. 13.

FIG. 14 shows (in an image view) a forecast tendency of a flow rate profile of the powder as obtained by using the vibration test machine shown in FIG. 13A. The horizontal axis of FIG. 14 represents the maximum acceleration brought about by the vibration of the vibrator 151. The vertical axis of FIG. 14 represents the flow rate (number of gram or grams per unit time) of the powder 8 allowed to flow downwardly through the circular tube section 153A. In other words, FIG. 14 shows the forecast tendency of the flow rate profile 141 of the powder 8 based on the correlative relationship between the flow rate of the powder 8 and the maximum acceleration brought about by the vibration of the vibrator 151.

Figure 15:
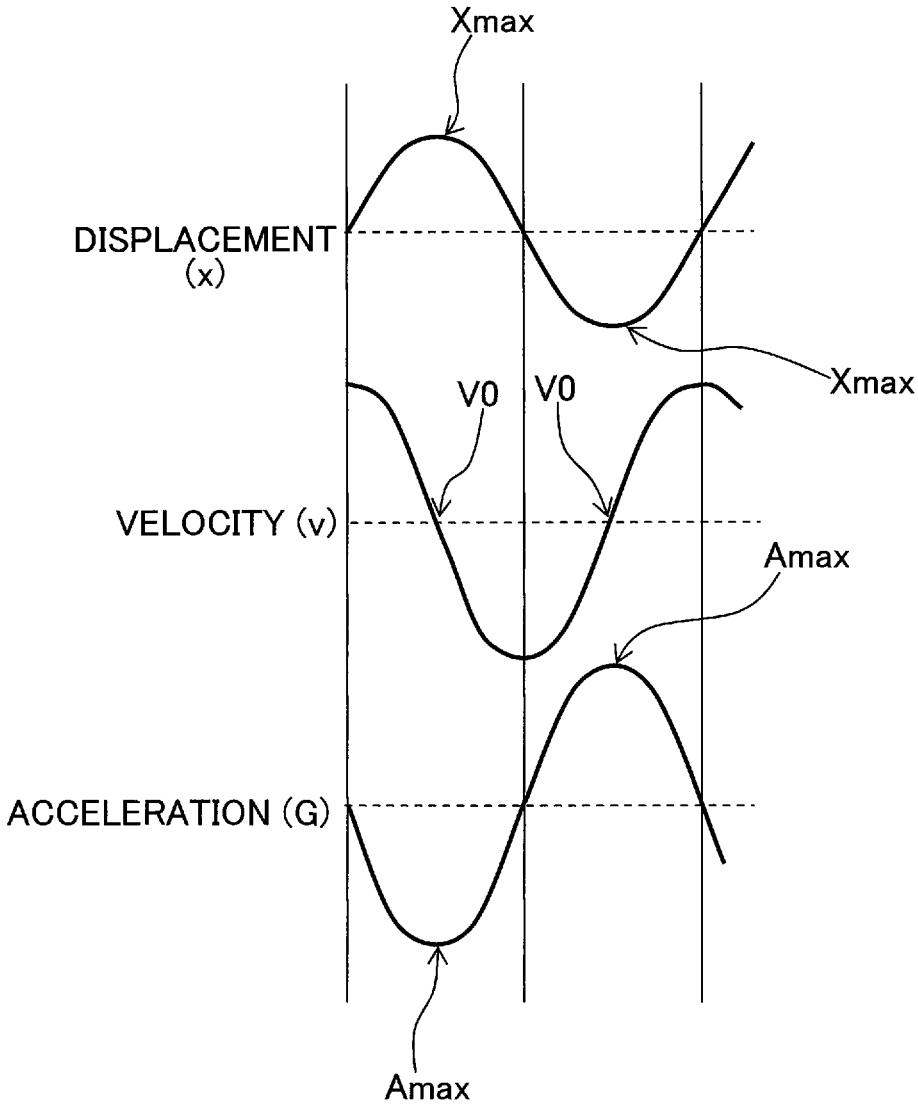
FIG. 15 shows the relationship of the displacement (x) of the vibration, the velocity (v), and the acceleration (G) in the case of the sine wave vibration.

In another viewpoint, the displacement (x) of the vibration, the velocity (v), and the acceleration (G) are, for example, in a relationship as shown in FIG. 15 as exemplified by a case of the sine wave vibration. The acceleration of vibration is changed depending on the displacement (amplitude) of the vibration and the frequency (oscillation frequency). The acceleration of gravity G (9.8 $m/s^2$) is used as the unit of the magnitude of the acceleration of vibration in many cases. In this specification, the maximum acceleration brought about by the vibration of the vibrator refers to the maximum value Amax of the acceleration (G) corresponding to the maximum value Xmax of the half amplitude of the vibration displacement (x) (zero value V0 in the case of the vibration velocity (v)) as shown in FIG. 15 in the case of the sine wave vibration. Therefore, when the amplitude and the frequency brought about by the vibration of the vibrator 151 is changed (adjusted) by using a driving power source (not shown) for the vibrator 151, it is possible to appropriately change the maximum acceleration brought about by the vibration of the vibrator 151.

As a result of the vibration test based on the use of the vibration test machine as described above, the present inventors have found out the following fact. That is, when the cross-sectional area S1 of the circular tube section 153A is 10% of the opening cross-sectional area S2 of the flow passage member 60 (correctly the opening cross-sectional area of the portion at which the vibrator 91 is attached as shown in a sectional view taken along XIIB-XIIB line in FIG. 12), the maximum acceleration brought about by the vibration of the vibrator 91 for avoiding the powder sedimentation is appropriately determined by grasping the maximum acceleration brought about by the vibration of the vibrator 151 when the clogging of the powder 8 is collapsed and the powder 8 is allowed to flow downwardly through the circular tube section 153A.

In view of the above, at first, the cross-sectional area S1 of the circular tube section 153A is made 10% of the opening cross-sectional area S2 of the flow passage member 60 to determine the flow rate profile 141 of the powder 8 as shown in FIG. 14. Accordingly, the preferred range of the maximum acceleration brought about by the vibration of the vibrator 91 attached to the flow passage member 60 can be specified to be not less than the maximum acceleration corresponding to the rising position A of the flow rate profile 141 of the powder 8.

Further, the more preferred range of the maximum acceleration brought about by the vibration of the vibrator 91 can be specified to be not less than the maximum acceleration corresponding to the position B of the flow rate profile 141 at which a half of the maximum value Qmax of the flow rate profile is provided.

However, if the maximum acceleration brought about by the vibration of the vibrator 91 is excessively large, various inconveniences arise in some cases (for example, the breakage of the structure by the vibrator 91 and the increase in the vibration energy loss). Therefore, the maximum acceleration brought about by the vibration of the vibrator 91 is preferably not more than twenty times the maximum acceleration corresponding to the rising position A of the flow rate profile 141, and more preferably not more than ten times the maximum acceleration corresponding to the rising position A of the flow rate profile 141.

As described above, the vibrator 91, which is attached to the flow passage member 60, applies, to the flow passage member 60, the maximum acceleration brought about by the vibration to the circular tube section 153A having the magnitude necessary to allow the powder 8 to flow downwardly, when the powder 8 is accommodated in the circular tube section 153A in which the internal cross-sectional area S1 is 10% of the opening cross-sectional area S2 of the flow passage member 60. Accordingly, the vibration condition is appropriately set for the vibrator 91 attached to the flow passage member 60. It is possible to enhance the fluidity of the powder 8 accommodated in the flow passage member 60. Consequently, it is possible to appropriately avoid the sedimentation of the powder 8, for example, on the inner wall of the flow passage member 60. When such a state is maintained over a long period of time, it is possible to extinguish the fear of the clog-up of the flow passage member 60 caused by the powder 8. As a result, the aerosol-generating apparatus 501A of this embodiment can appropriately transport various types of powders 8 (material particles M).

The exemplary arrangement has been described above, in which the vibrator 91 for avoiding the powder sedimentation is arranged for the flow passage member 60 of the aerosol-generating apparatus 501. However, the technique for avoiding the powder sedimentation of this embodiment is not limited thereto, which is applicable to various transport mechanisms for handling the powder (for example, a diaphragm pump, a screw feeder, or a uniaxial eccentric pump).

Figure 16:
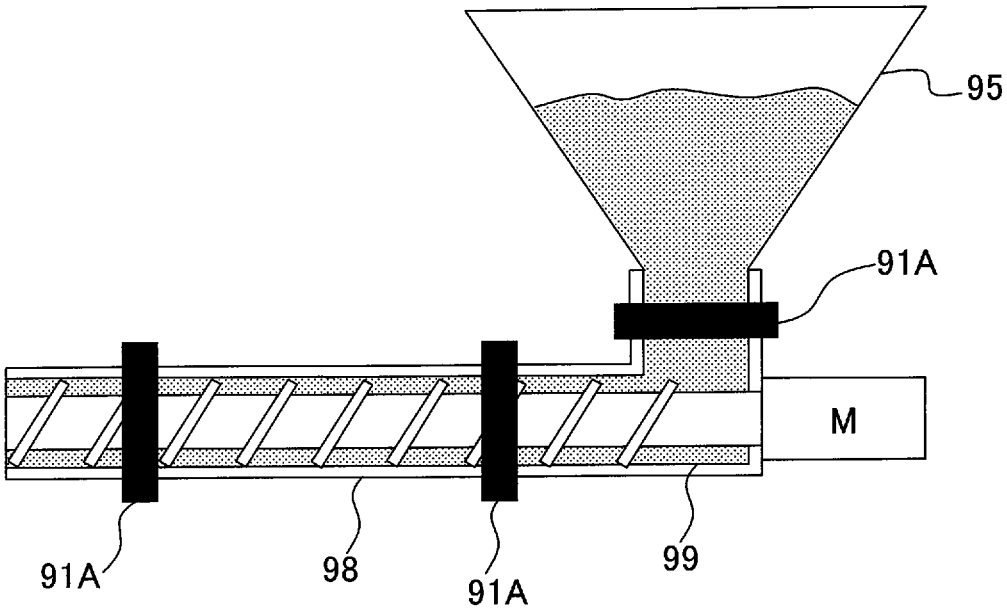
FIG. 16 schematically shows an exemplary arrangement of a screw feeder attached with a vibrator for preventing the powder sedimentation.

For example, FIG. 16 shows an example in which a vibrator 91A, which is of the same type as that of the vibrator 91, is attached to a casing section 98 of a screw feeder. Accordingly, it is possible to appropriately avoid the sedimentation of the powder, for example, on the inner surface of a hopper 95 of the screw feeder, the surface of a screw 99, and the inner wall of the casing section 98.

The cylindrical accommodating vessel 5 is used in the embodiments and the modified embodiments described above. However, the present invention is not limited thereto. It is possible to use the accommodating vessel having any arbitrary shape. The description has been made as exemplified by the mass flow controller as the flow rate controller for controlling the flow rate of the gas by way of example. However, there is no limitation thereto. It is possible to use any arbitrary gas flow rate-adjusting mechanism. The film-forming mechanism 20 is provided with the first and second vacuum pumps 31, 32. However, it is not necessarily indispensable that the film-forming mechanism is provided with the vacuum pump or vacuum pumps. For example, any vacuum pump, which is equipped for the factory or the like, can be used by being connected to the film-forming chamber 30.

According to the aerosol-generating apparatus and the aerosol-generating method of the present invention, it is possible to stably produce the aerosol over a long term by appropriately reducing the aggregation of the material particles of the powder accommodated in the powder-accommodating chamber. Therefore, the present invention can be utilized for the film-forming apparatus based on the use of the AD method.

What is claimed is:

1. An aerosol-generating apparatus which generates an aerosol by dispersing material particles in a carrier gas, the aerosol-generating apparatus comprising:

a body having a powder-accommodating chamber which accommodates a powder of the material particles, and an introducing port which is formed in the powder-accommodating chamber and via which the carrier gas is introduced into the powder-accommodating chamber;

a powder flow passage which has an inlet opening and an outlet opening both of which are open in the powder-accommodating chamber, the inlet opening being positioned at a position lower than that of the outlet opening in a vertical direction;

a gas-jetting mechanism configured to jet the carrier gas toward falling powder falling from the outlet opening of the powder flow passage toward a powder surface, wherein the gas-jetting mechanism comprises a plurality of jetting ports disposed in the powder-accommodating chamber between the outlet opening and the inlet opening and configured to jet the carrier gas toward the falling powder, and wherein the plurality of jetting ports are disposed such that the gas-jetting mechanism is configured to jet the carrier gas in a substantially annular jetting area; and a transport mechanism which transports the powder accommodated in the powder flow passage in a direction directed from the inlet opening to the outlet opening of the powder flow passage, wherein the powder flow passage is formed of a flow passage member, wherein the transport mechanism has a vibrator which is configured to vibrate the flow passage member to transport the powder accommodated in the powder flow passage, wherein the vibrator is configured to vibrate the flow passage member by generating two waves of a progressive wave and a stationary wave in the flow passage member to transport the powder, and wherein the vibrator is further configured to apply, to the flow passage member, a maximum acceleration brought about by vibration applied by the vibrator to the flow passage member, the vibration having a magnitude necessary to make the powder to flow downwardly when the powder is accommodated in the flow passage member formed with a columnar internal space having a cross-sectional area which is 10% of an opening cross-sectional area of the flow passage member of the powder flow passage.

2. The aerosol-generating apparatus according to claim 1, wherein the gas-jetting mechanism is further configured to pulverize aggregates of the material particles.

3. The aerosol-generating apparatus according to claim 1, further comprising a carrier gas supply mechanism which supplies the carrier gas from outside of the body to the powder-accommodating chamber via the introducing port.

4. The aerosol-generating apparatus according to claim 1, wherein the vibrator is attached to one of a portion of the flow passage member which is located in the vicinity of the inlet opening and another portion of the flow passage member which is located in the vicinity of the outlet opening.

5. The aerosol-generating apparatus according to claim 4, wherein the vibrator is attached only to the another portion of the flow passage member which is located in the vicinity of the outlet opening.

6. The aerosol-generating apparatus according to claim 3, wherein the body has a penetrating pore member in which a plurality of penetrating pores is formed;

the powder-accommodating chamber has a carrier gas-introducing chamber which is formed in a lower portion of the powder-accommodating chamber, by comparting the powder-accommodating chamber by the penetrating pore member;

the introducing port is formed in the carrier gas-introducing chamber; and a discharge opening through which the carrier gas is discharged is formed in the carrier gas supply mechanism to be connected to the introducing port formed in the carrier gas-introducing chamber.

7. The aerosol-generating apparatus according to claim 3, wherein the powder flow passage is formed of a tubular member, and the inlet opening is positioned in a layer of the powder accommodated in the powder-accommodating chamber.

8. The aerosol-generating apparatus according to claim 7, wherein the tubular member is a linear tube-shaped member having a central axis extending substantially in the vertical direction; and the tubular member penetrates through a substantially central portion of a horizontal cross section of the powder-accommodating chamber at a position corresponding to a top of a powder surface.

9. The aerosol-generating apparatus according to claim 6, wherein the penetrating pore member is a funnel-shaped member in which a discharge port is formed;

the inlet opening of the powder flow passage is connected to the discharge port of the funnel-shaped penetrating pore member; and the outlet opening of the powder flow passage is arranged inside the powder-accommodating chamber.

10. The aerosol-generating apparatus according to claim 6, wherein the inlet opening of the powder flow passage is formed on an inner wall surface of the powder-accommodating chamber; and the outlet opening of the powder flow passage is arranged inside the powder-accommodating chamber.

11. The aerosol-generating apparatus according to claim 10, wherein an angle formed with respect to a horizontal plane by a straight line connecting the outlet opening and a position is always larger than an angle of repose of the powder of the material particles, the position being a position on the inner wall surface that opposes the opening of the powder-accommodating chamber.

12. The aerosol-generating apparatus according to claim 10, wherein an angle formed with respect to a horizontal plane by a straight line connecting the inlet opening and the outlet opening is always larger than an angle of repose of the powder of the material particles.

13. The aerosol-generating apparatus according to claim 10, wherein the penetrating pore member is a plate-shaped member which is arranged to incline such that the powder of the material particles is moved toward the inlet opening by a self-weight of the material particles.

14. The aerosol-generating apparatus according to claim 1, wherein the magnitude of the maximum acceleration brought about by the vibration of the vibrator is set to be not less than a value corresponding to a rising position of a flow rate profile of the powder based on a correlative relationship between the maximum acceleration and a flow rate of the powder flowing through the tube member.

15. The aerosol-generating apparatus according to claim 14, wherein the magnitude of the maximum acceleration brought about by the vibration of the vibrator is set to be not less than a value corresponding to a position of the flow rate profile which provides a half of a maximum value of the flow rate profile.

16. The aerosol-generating apparatus according to claim 14, wherein the maximum acceleration brought about by the vibration of the vibrator is set to be not more than twenty times the value corresponding to the rising position of the flow rate profile.

17. The aerosol-generating apparatus according to claim 1, wherein the gas-jetting mechanism is further configured to crush the material particles into fragments in addition to pulverizing the aggregates of the material particles.

18. The aerosol-generating apparatus according to claim 1, wherein the gas-jetting mechanism is further configured to pulverize the aggregates of the material particles without crushing the material particles into fragments.

19. The aerosol-generating apparatus according to claim 1, wherein the gas-jetting mechanism is further configured to perform a first mode in which the material particles are crushed into fragments in addition to pulverizing the aggregates of the material particles, and a second mode in which the aggregates of the material particles are pulverized without crushing the material particles into fragments.

* * * * *